US007749609B2

(12) United States Patent
Kaimura et al.

(10) Patent No.: US 7,749,609 B2
(45) Date of Patent: Jul. 6, 2010

(54) METAL PLATE FOR PRODUCING FLAT TUBE, FLAT TUBE AND PROCESS FOR PRODUCING THE FLAT TUBE

(75) Inventors: Satoru Kaimura, Oyama-shi (JP); Yasuji Kawamata, Oyama-shi (JP); Takashi Tamura, Oyama-shi (JP); Ryoichi Hoshino, Oyama-shi (JP); Noboru Ogasawara, Oyama-shi (JP)

(73) Assignee: Showa Denko K.K., Tokyo (JP)

( * ) Notice: Subject to any disclaimer, the term of this patent is extended or adjusted under 35 U.S.C. 154(b) by 160 days.

(21) Appl. No.: 11/964,412

(22) Filed: Dec. 26, 2007

(65) Prior Publication Data

US 2008/0105322 A1 May 8, 2008

Related U.S. Application Data

(62) Division of application No. 10/479,860, filed on Dec. 8, 2003, now Pat. No. 7,341,099.

(60) Provisional application No. 60/307,164, filed on Jul. 24, 2001.

(51) Int. Cl.
*F28F 1/02* (2006.01)
*B21D 53/06* (2006.01)

(52) U.S. Cl. ..... 428/595; 428/600; 165/177

(58) Field of Classification Search ..... 428/595, 428/600

See application file for complete search history.

(56) References Cited

U.S. PATENT DOCUMENTS 578,801 A 3/1897 Wilmot
752,694 A 2/1904 Lund
1,891,740 A * 12/1932 Westerman ..... 138/165
2,023,047 A * 12/1935 Ganoe ..... 138/166
2,151,540 A * 3/1939 Varga ..... 138/117

(Continued)

FOREIGN PATENT DOCUMENTS

DE 3731669 4/1989

(Continued)

OTHER PUBLICATIONS

U.S. Appl. No. 10/586,588, filed Jul. 20, 2006, Kaimura, et al.
U.S. Appl. No. 11/572,320, filed Jan. 19, 2007, Numasawa, et al.

*Primary Examiner*—John J Zimmerman
(74) *Attorney, Agent, or Firm*—Oblon, Spivak, McClelland, Maier & Neustadt, L.L.P.

(57) ABSTRACT

A metal plate for producing a flat tube including a metal body having a joint portion, first and second flat wall forming portions connected by the joint portion, reinforcing wall forming portions projecting from the first and second flat wall forming portions and extending in a longitudinal direction of the first and second flat wall forming portions, and side wall forming portions projecting from opposite side edges of the metal body, respectively. The joint portion has a ridge which makes the joint portion thicker than the first and second flat wall forming portions. The ridge, the reinforcing wall forming portions and the side wall forming portions are projecting in a same direction. The metal body bends into a hairpin shape at boundaries formed between the ridge of the joint portion and the first and second flat wall forming portions.

6 Claims, 11 Drawing Sheets

U.S. PATENT DOCUMENTS

| | | | | | |
|---|---|---|---|---|---|
| 2,231,749 | A | * | 2/1941 | Damerell | 416/233 |
| 4,279,139 | A | * | 7/1981 | Schmitz | 72/234 |
| 5,553,377 | A | * | 9/1996 | Hirano et al. | 29/890.053 |
| 5,784,776 | A | * | 7/1998 | Saito et al. | 29/890.046 |
| 5,881,457 | A | | 3/1999 | Liu | |
| 6,423,423 | B2 | * | 7/2002 | Akutsu et al. | 428/577 |
| 7,025,393 | B2 | | 4/2006 | Amedure et al. | |
| 7,341,099 | B2 | * | 3/2008 | Kaimura et al. | 165/152 |
| 2007/0051499 | A1 | | 3/2007 | Kaimura et al. | |
| 2008/0245518 | A1 | * | 10/2008 | Kaimura et al. | 165/177 |
| 2008/0264620 | A1 | * | 10/2008 | Numasawa et al. | 165/177 |

FOREIGN PATENT DOCUMENTS

| | | | |
|---|---|---|---|
| FR | 2757615 | A1 * | 6/1998 |
| JP | 05-164484 | | 6/1993 |
| JP | 08-327266 | * | 12/1996 |
| JP | 10-015619 | * | 1/1998 |
| JP | 10-141879 | | 5/1998 |
| JP | 2000-74586 | | 3/2000 |
| JP | 2001-174167 | | 6/2001 |
| JP | 2002-143959 | | 5/2002 |
| JP | 2004-167601 | | 6/2004 |
| JP | 2004-344913 | | 12/2004 |

* cited by examiner

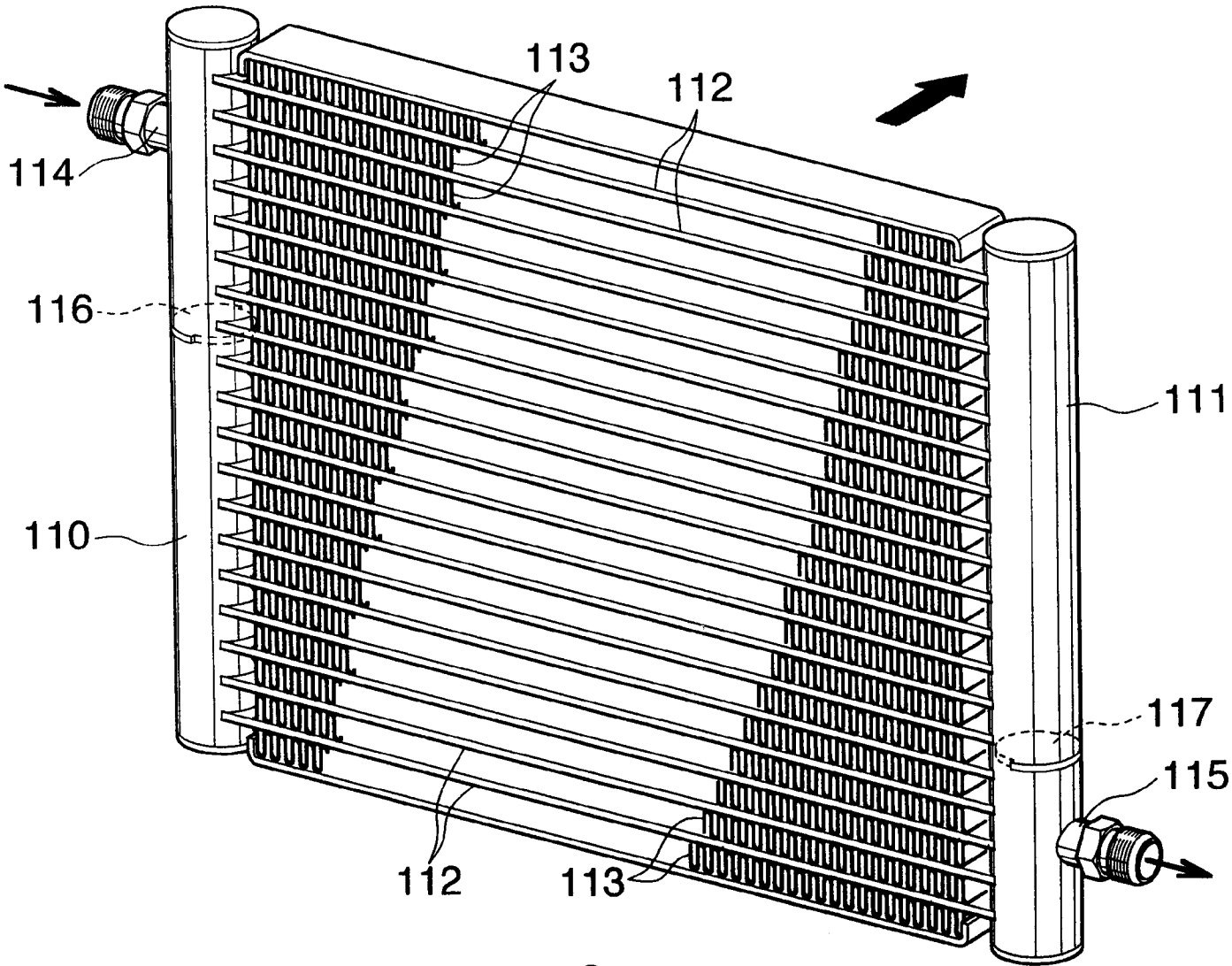
BACKGROUND ART Fig.16

METAL PLATE FOR PRODUCING FLAT TUBE, FLAT TUBE AND PROCESS FOR PRODUCING THE FLAT TUBE

CROSS REFERENCE TO RELATED APPLICATIONS

This application is a division of and claims the benefit of priority under 35 U.S.C. §120 from U.S. Ser. No. 10/479,860, filed Dec. 8, 2003, now U.S. Pat. No. 7,341,099, issued Mar. 11, 2008, claiming the benefit pursuant to 35 U.S.C. §119(e)(1) of the filing data of Provisional Application No. 60/307,164 filed Jul. 24, 2001 pursuant to 35 U.S.C. §111(b), and further claims the benefit of priority under 35 U.S.C. §119 from Japanese Patent Application No. 2001-174459, filed Jun. 8, 2001.

TECHNICAL FIELD

The present invention relates to metal plates for producing heat exchange tubes for heat exchangers, for example, flat tubes for use as refrigerant flow tubes in condensers for motor vehicle air conditioners, flat tubes and a process for producing the flat tube.

BACKGROUND ART

In recent years, widely used in motor vehicle air conditioners in place of conventional serpentine condensers are condensers which comprise, as shown in FIG. 16, a pair of headers 110, 111 arranged in parallel and spaced apart from each other, parallel flat refrigerant flow tubes 112 made of aluminum and each joined at its opposite ends to the two headers 110, 111, corrugated aluminum fins 113 each disposed in an air flow clearance between the adjacent refrigerant tubes 112 and brazed to the adjacent tubes, an inlet pipe 114 connected to the upper end of peripheral wall of the first 110 of the headers, an outlet pipe 115 connected to the lower end of peripheral wall of the second 111 of the headers, a first partition 116 provided inside the first header 110 and positioned above the midportion thereof, and a second partition 117 provided inside the second header 111 and positioned below the midportion thereof, the number of refrigerant tubes 112 between the inlet pipe 114 and the first partition 116, the number of refrigerant tubes 112 between the first partition 116 and the second partition 117 and the number of refrigerant tubes 112 between the second partition 117 and the outlet pipe 115 decreasing from above downward to provide groups of channels. A refrigerant flowing into the inlet pipe 114 in a vapor phase flows zigzag through units of passage groups in the condenser before flowing out from the outlet pipe 115 in a liquid phase. The condensers of the construction described (see JP-B No. 45300/1991) are called multiflow condensers, and realize high efficiencies, lower pressure losses and super-compactness.

It is required that the refrigerant flow tube 112 of the condenser described be excellent in heat exchange efficiency and have pressure resistance against the high-pressure gaseous refrigerant to be introduced thereinto. Moreover, the tube needs to be small in wall thickness and low in height so as to make the condenser compact.

Such a flat tube for use as a refrigerant flow tube is known as disclosed, for example, in U.S. Pat. No. 5,553,377. The disclosed flat tube comprises a pair of flat walls opposed to each other, two side walls interconnecting opposite side edges of the two flat walls, and a plurality of reinforcing walls interconnecting the flat walls, extending longitudinally of the tube and spaced apart from one another by a predetermined distance. The flat tube is made from a metal plate which has two flat wall forming portions connected together by a joint portion, a plurality of reinforcing wall forming portions upwardly projecting from each of the wall forming portions integrally therewith, and side wall forming portions formed respectively at opposite side edges of the plate and upwardly projecting therefrom integrally therewith, by bending the metal plate into the form of a hairpin at the joint portion by the roll forming process. The flat walls are formed by the flat wall forming portions, and one of the side walls is formed by the joint portion. The reinforming wall forming portions and the side wall forming portion on one of the flat wall forming portions are brazed to those on the other flat wall forming portions in corresponding relation end-to-end, whereby the reinforcing walls and the other side wall are formed.

When the metal plate is bent in the form of a hairpin by roll forming in producing the conventional flat tube, the reinforcing wall forming portions, as well as the side wall forming portions, are joined together in corresponding pairs without displacement, whereas when a pressure acts on the plate during brazing to bring the two flat wall forming portions toward each other, it is likely that the reinforcing wall forming portions in each pair, as well as the side wall forming portions, will be displaced from each other widthwise of the flat wall forming portions. If the plate is brazed in this state, the length or area of the joint to be formed between each corresponding pair or the side wall forming portions will become smaller or no joint will be formed locally, entailing the problem of seriously impaired pressure resistance or leakage of the fluid flowing through the flat tube.

An object of the present invention is to overcome the above problem, to provide a metal plate for use in producing a flat tube which makes it possible to join the corresponding pairs of reinforcing wall forming portions, as well as the side wall forming portions, without displacement after the plate is bent into the shape of a hairpin, and to provide the flat tube and a process for producing the flat tube.

DISCLOSURE OF THE INVENTION

The present invention provides a first metal plate for use in producing a flat tube which comprises a pair of flat walls opposed to each other, two side walls interconnecting opposite side edges of the two flat walls, and a plurality of reinforcing walls interconnecting the flat walls, extending longitudinally of the tube and spaced apart from one another by a predetermined distance, the metal plate comprising two flat wall forming portions connected together by a joint portion, a plurality of reinforcing wall forming portions upwardly projecting from each of the wall forming portions integrally therewith, and a side wall forming portion formed at each of opposite side edges of the plate and upwardly projecting therefrom integrally therewith, an engaging portion being formed at an upper end of at least one of the side wall forming portion and the reinforcing wall forming portions, an engaging portion being formed at an upper end of the wall forming portion to be butted against said at least one wall forming portion when the metal plate is bent into the shape of a hairpin, the engaging portions being engageable with each other to prevent the flat wall forming portions from being displaced widthwise thereof.

With the first metal plate of the invention, an engaging portion formed at an upper end of at least one of the side wall forming portions and the reinforcing wall forming portions and an engaging portion formed at an upper end of the wall forming portion to be butted against above-mentioned at least one wall forming portion when the metal plate is bent into the shape of a hairpin are engaged with each other to prevent the wall forming portions from being displaced in the direction of thickness thereof. Accordingly, when the metal plate is bent into the shape of a hairpin at the joint portion, for example, by roll forming, each pair of corresponding reinforcing wall forming portions, as well as the side wall forming portions, are butted against each other without displacement, and the engaging portions of the wall forming portions are engaged with each other. Even when the two flat wall forming portions are pressed toward each other for brazing, the engagement between the engaging portions prevents the wall forming portions provided with the engaging portions from being displaced in the direction of thickness thereof, i.e., widthwise of the flat wall forming portions, whereby each of opposed pairs of other wall forming portions are also prevented from being displaced from each other in the direction of thickness thereof, i.e., widthwise of the flat wall forming portions. When the resulting plate is brazed in this state, the reinforcing wall forming portions and the side wall forming portions are reliably brazed in corresponding or mating pairs over the entire length thereof, consequently giving remarkably enhanced pressure resistance to the flat tube obtained. Incidentally, the term "aluminum" as used herein includes aluminum alloys in addition to pure aluminum. The upper and lower sides and the left-hand and right-hand sides of FIGS. 2, 4, 7 and 13 will herein be referred to as "upper," "lower," "left" and "right," respectively.

The present invention provides a second metal plate for use in producing a flat tube which plate comprises the first metal plate and in which a projection is formed at the upper end of at least one of the side wall forming portions and the reinforcing wall forming portions, and a recess for the projection to fit in is formed in the upper end of the wall forming portion to be butted against said at least one wall forming portion.

The present invention provides a third metal plate for use in producing a flat tube which plate comprises the second metal plate, the third metal plate being adapted to satisfy the relationships of:

$$A>a,\ A/a\leqq 1.5,\ B/b\leqq 1.5,\ C/c\leqq 1.5,\ \text{and}\ D/d/\leqq 1.5$$

wherein A is the cross sectional area of the projection in section along a plane perpendicular to the longitudinal direction of the wall forming portion, B is the height of the projection, C is the maximum width of the projection in the direction of thickness of the wall forming portion, D is the width of an upper end of the projection in the direction of thickness of the wall forming portion, a is the cross sectional area of the recess in section along a plane perpendicular to the longitudinal direction of the wall forming portion, b is the depth of the recess, c is the maximum width of the recess in the direction of thickness of the wall forming portion, and d is the width of an opening of the recess in the direction of thickness of the wall forming portion.

When the third metal plate is bent at the joint portion into the shape of a hairpin to butt the reinforcing wall forming portions and the side wall forming portions in corresponding or mating pairs with the projection forced into the recess, the projection and recess are deformed, and the frictional force acting between opposite side faces of the projection and opposite side faces defining the recess prevents the projection from slipping out of the recess, consequently holding the metal plate in the bent state against a springback force and eliminating the need for a jig for holding the plate in the bent state for brazing. When a condenser is to be fabricated simultaneously with the production of flat tubes, this makes the tacked metal plates easy to handle, therefore rendering the condenser easy to fabricate.

With the third metal plate, the cross sectional area of the projection and that of the recess have the relationship of $A>a$ because when the metal plate is bent at the joint portion into the shape of hairpin to butt the reinforcing wall forming portions and the side wall forming portions in corresponding pairs, with the projection forced into the recess, in this case, the frictional force between opposite side faces of the projection and opposite side faces defining the recess prevents the projection from slipping out of the recess.

Similarly, the ratio of the cross sectional area of the projection to that of the recess is made equal to or less than 1.5, i.e., $A/a\leqq 1.5$, because if A/a is in excess of 1.5, the projection and the recess deform markedly, with the projection prevented from slipping out of the recess less effectively, when the metal plate is bent at the joint portion into the shape of hairpin to butt the reinforcing wall forming portions and the side wall forming portions in corresponding pairs. Moreover, the area of contact between the upper ends of the wall forming portions having the projection and the recess becomes smaller, possibly producing a faulty joint between the butting ends. Preferably, the ratio of the cross sectional area of the projection to that of the recess is in the range of $1.05\leqq A/a\leqq 1.3$.

The ratio of the height of the projection to the depth of the recess, B/b, is made equal to or less than 1.5, and the ratio of the maximum width of the projection to the maximum width of the recess, C/c, is made equal to or less than 1.5 because if these ratios are in excess of 1.5, buckling or like deformation occurs in the projection to impair the effect to prevent the projection from slipping out of the recess. Preferably, the ratio of the height of the projection to the depth of the recess is $1.0\leqq B/b\leqq 1.3$, and the ratio of the maximum width of the projection to the maximum width of the recess is $1.0\leqq C/c\leqq 1.3$.

The ratio of the width of the upper end of the projection to the width of the opening of the recess is made equal to or less than 1.5 because if the ratio is over 1.5, the recess deforms markedly to impair the effect to prevent the projection from slipping out of the recess. Preferably, the ratio of the width of the upper end of the projection to the width of the opening of the recess is $0.9\leqq D/d\leqq 1.2$.

In the third metal plate, the projection and the recess, each one in number, may be formed in the respective wall forming portions, and the metal plate satisfies the relationship of $0.01\leqq L1/L\leqq 1$ wherein L1 is the length of the projection and the length of the recess, and L is the length of each wall forming portion. The length of the projection and the recess and the length of the wall forming portion are in the relationship of $0.01\leqq L1/L\leqq 1$ because if L1/L is less than 0.01, the effect to prevent the projection from slipping out of the recess by virtue of the frictional force acting between the side faces of the projection and the side faces defining the recess diminishes. The ratio L1/L which is 1 means that the projection and the recess extend over the entire length of the wall forming portion. Preferably, the lower limit of L1/L is 0.05, and the upper limit thereof is 1.

With the third metal plate, the wall forming portions may be provided with a plurality of projections and a plurality of recesses, respectively, as arranged at a spacing longitudinally of the wall forming portion, the metal plate satisfying the relationship of $0.01\leqq L2/L$ wherein L2 is the combined length of all the projections and the recesses, and L is the length of each wall forming portion. The combined length of all the projections and the recesses and the length of the wall forming portion are in the relation of $0.01 \leqq L2/L$ because if the ratio L2/L is less than 0.01, the effect to prevent the projection from slipping out of the recess will diminish in the case where the prevention is to be attained by the frictional force between the side faces of the projection and the recess-defining side faces. Since the projections and the recesses are arranged at a spacing, the upper limit of L2/L is less than 1. The lower limit of this ratio is preferably 0.05. The upper limit is preferably approximate to 1.

In the third metal plate, the joint portion may have a larger thickness than the flat wall forming portions.

The invention provides a fourth metal plate for producing a flat tube which plate comprises the second metal plate wherein the upper end of the wall forming portion having the recess formed therein is provided at least one of opposite sides of the recess with a subprojection deformable when the projection is fitted into the recess to press a side face of the projection, the metal plate satisfying the relationship of $0.01 \leqq E/(A+a) \leqq 0.5$ wherein A is the cross sectional area of the projection in section along a plane perpendicular to the longitudinal direction of the wall forming portion, a is the cross sectional area of the recess in section along like plane, and E is the combined cross sectional area of subprojections.

When the fourth metal plate is bent at the joint portion into the shape of a hairpin to butt the reinforcing wall forming portions and the side wall forming portions in corresponding or mating pairs with the projection fitted into the recess, the subprojection deforms to press the side face of the projection, whereby the projection is prevented from slipping out of the recess. The metal plate is therefore held in the bent state against a springback force. This eliminates the need for a jig for holding the plate in the bent state for brazing. When a condenser is to be fabricated simultaneously with the production of flat tubes, the metal plates as tacked in the bent state become easy to handle, therefore rendering the condenser easy to fabricate.

With the fourth metal plate, the cross sectional area of the projection, the cross sectional area of the recess and the combined cross sectional area of subprojections are in the relationship of $0.01 \leqq E/(A+a) \leqq 0.5$ because if the ratio E/(A+a) is less than 0.01, the effect to prevent the projection from slipping out of the recess will be lower, whereas if the ratio is over 0.5, the area of contact between the ends of the wall forming portions respectively having the projection and the recess becomes smaller to result in a likelihood that the joint between the two portions, e.g., brazed joint, will become faulty. If the subprojection is formed at only one side of the recess, the combined cross sectional area is the area of the one subprojection. The combined area is the sum of the cross sectional areas of two subprojections when the subprojection is formed at each side of the recess. The cross sectional area of the projection, the cross sectional area of the recess and the combined cross sectional area of subprojections are preferably in the relationship of $0.05 \leqq E/(A+a) \leqq 0.3$.

In cross section along a plane perpendicular to the longitudinal direction of the wall forming portion, the subprojection of the fourth metal plate may have a first part continuous with a side face defining the recess, and a second part extending from an end of the first part and inclined toward the end face of the wall forming portion in a direction away from the recess. The subprojection then acts to press the side face of the projection more effectively upon deforming. The end face of the wall forming portion having the projection may be provided with a subrecess for the subprojection to fit in. Furthermore, the joint portion may be given a larger thickness than the flat wall forming portions.

In the fourth metal plate, the projection and the recess, each one in number, may be formed in the respective wall forming portions, and the metal plate satisfies the relationship of $0.01 \leqq L1/L \leqq 1$ wherein L1 is the length of the projection and the length of the recess, and L is the length of each wall forming portion. The length of the projection and the recess and the length of the wall forming portion are in the relationship of $0.01 \leqq L1/L \leqq 1$ because if L1/L is less than 0.01, lower will be the effect to prevent the projection from slipping out of the recess by the subprojection so deformed as to press the side face of the projection. The ratio L1/L which is 1 means that the projection and the recess extend over the entire length of the wall forming portion. Preferably, the lower limit of L1/L is 0.05, and the upper limit thereof is 1.

With the fourth metal plate, the wall forming portions may be provided with a plurality of projections and a plurality of recesses, respectively, as arranged at a spacing longitudinally of the wall forming portion, the metal plate satisfying the relationship of $0.01 \leqq L2/L$ wherein L2 is the combined length of all the projections and the recesses, and L is the length of each wall forming portion. The combined length of all the projections and the recesses and the length of the wall forming portion are in the relation of $0.01 \leqq L2/L$ because if the ratio L2/L is less than 0.01, the effect to prevent the projection from slipping out of the recess will diminish in the case where the prevention is to be attained by the subprojection which is so deformed as to press the side face of the projection. Since the projections and the recesses are arranged at a spacing, the upper limit of L2/L is less than 1. The lower limit of this ratio is preferably 0.05. The upper limit is preferably approximate to 1.

For the same reasons as described for the third metal plate, the fourth metal plate may satisfy the relationships of:

$$A>a,\ A/a \leqq 1.5,\ B/b \leqq 1.5,\ C/c \leqq 1.5,\ \text{and}\ D/d/ \leqq 1.5$$

wherein A is the cross sectional area of the projection in section along a plane perpendicular to the longitudinal direction of the wall forming portion, B is the height of the projection, C is the maximum width of the projection in the direction of thickness of the wall forming portion, D is the width of an upper end of the projection in the direction of thickness of the wall forming portion, a is the cross sectional area of the recess in section along a plane perpendicular to the longitudinal direction of the wall forming portion, b is the depth of the recess, c is the maximum width of the recess in the direction of thickness of the wall forming portion, and d is the width of an opening of the recess in the direction of thickness of the wall forming portion.

The present invention provides a fifth metal plate for use in producing a flat tube which plate comprises the first metal plate wherein a left part of the upper end of at least one of the side wall forming portion on the flat wall forming portion at left and the reinforcing wall forming portions on the left flat wall forming portion and a right part of the upper end of at least one of the remainder of these wall forming portions are each provided with an engaging ridge extending longitudinally of the wall forming portion, and a left part of the upper end of the wall forming portion formed on the flat wall forming portion at right and to be butted against the wall forming portion of the left flat wall forming portion having the engaging ridge at the left part thereof and a right part of the wall forming portion formed on the right flat wall forming portion and to be butted against the wall forming portion of the left flat wall forming portion having the engaging ridge at the right part thereof are each provided with an engaging ridge extending longitudinally of the wall forming portion and engageable with the engaging ridge on the left flat wall forming portion.

The present invention provides a sixth metal plate for use in producing a flat tube comprising a pair of flat walls opposed to each other, two side walls interconnecting opposite side edges of the two flat walls, and a plurality of reinforcing walls interconnecting the flat walls, extending longitudinally of the tube and spaced apart from one another by a predetermined distance, the metal plate comprising two flat wall forming portions connected together by a joint portion, a plurality of reinforcing wall forming portions upwardly projecting from each of the wall forming portions integrally therewith, and a side wall forming portion formed at each of opposite side edges of the plate and upwardly projecting therefrom integrally therewith, the joint portion having a larger thickness than the flat wall forming portions.

With the sixth metal plate, the joint portion of the plate is given a larger thickness than the two flat wall forming portions, so that when the metal plate is bent into the shape of a hairpin at the joint portion by roll forming, the joint portion functions to permit the plate to be bent accurately to butt the reinforcing wall forming portions and the side wall forming portion in corresponding or mating pairs free of displacement and to ensure engagement between the engaging portions of the reinforce wall portions. When the flat wall forming portions are subjected to a pressure acting to bring these portions toward each other, the joint portion of increased thickness acts to prevent the reinforcing wall forming portions of each pair, as well as the side wall forming portions, from becoming displaced from each other in the direction of thickness thereof, i.e., widthwise of the flat wall forming portions. When the bent plate is brazed in this state, the reinforcing wall forming portions and the side wall forming portions are reliably brazed over the entire length thereof to give remarkably improved pressure resistance to the flat tube produced.

The sixth metal plate may be provided in an upper surface thereof with a score extending over the entire length the plate and positioned at each of boundaries between the joint portion and the two flat wall forming portions. Alternatively, the metal plate may be provided in each of upper and lower surfaces thereof with a score extending over the entire length the plate and positioned at each of boundaries between the joint portion and the two flat wall forming portions. The joint portion may be provided in an upper surface thereof with a furrow extending over the entire length the plate. Furthermore, the metal plate may be provided in a lower surface thereof with a score extending over the entire length the plate and positioned at each of boundaries between the joint portion and the two flat wall forming portions, the joint portion being provided in an upper surface thereof with a furrow extending over the entire length the plate. In these cases, the metal plate can be bent into the shape of a hairpin at the joint portion with high accuracy, preventing the reinforcing wall forming portions in each pair and the side wall forming portions from becoming displaced from each other with improved effectiveness.

Preferably, the first to sixth metal plates described are each made from an aluminum brazing sheet by rolling, the side wall forming portions and the reinforcing wall forming portions are formed on a brazing material bearing surface of the brazing sheet integrally therewith, and a brazing material layer is formed on the upper end faces of the side wall forming portions and the reinforcing wall forming portions. When the reinforcing wall forming portions and the side wall forming portions are to be brazed after the plate is bent into the shape of a hairpin at the joint portion, the brazing material layer on the ends of these wall forming portions is utilized for brazing. This obviates the need for an additional manual procedure for applying a brazing agent.

The present invention provides a first flat tube which is made from the third metal plate by bending the metal plate into the shape of a hairpin at the joint portion to form flat walls by the flat wall forming portions and one side wall by the joint portion, to butt the reinforcing wall forming portions and the side wall forming portion in corresponding mating pairs and to force the projection into the recess, and joining the reinforcing forming portions and the side wall forming portions in corresponding mating pairs in this state to form reinforcing walls and the other side wall.

The present invention provides a second flat tube which is made from the fourth metal plate by bending the metal plate into the shape of a hairpin at the joint portion to form flat walls by the flat wall forming portions and one side wall by the joint portion, to butt the reinforcing wall forming portions and the side wall forming portion in corresponding mating pairs, to fit the projection into the recess and to deform the subprojection so as to cause the subprojection to press a side face of the projection, and joining the reinforcing forming portions and the side wall forming portions in corresponding mating pairs in this state to form reinforcing walls and the other side wall.

The present invention provides a first process for producing a flat tube from the third metal plate which process includes bending the metal plate into the shape of a hairpin at the joint portion to form flat walls by the flat wall forming portions and one side wall by the joint portion, to butt the reinforcing wall forming portions and the side wall forming portion in corresponding mating pairs, to force the projection into the recess, to thereby prevent the projection from slipping out of the recess and to tack the metal plate as bent, and joining the reinforcing forming portions and the side wall forming portions in corresponding mating pairs in this state to form reinforcing walls and the other side wall.

The present invention provides a second process for producing a flat tube from the fourth metal plate which process includes bending the metal plate into the shape of a hairpin at the joint portion to form flat walls by the flat wall forming portions and one side wall by the joint portion, to butt the reinforcing wall forming portions and the side wall forming portion in corresponding mating pairs, to fit the projection into the recess, to deform the subprojection so as to cause the subprojection to press a side face of the projection, to thereby prevent the projection from slipping out of the recess and to tack the metal plate as bent, and joining the reinforcing forming portions and the side wall forming portions in corresponding mating pairs in this state to form reinforcing walls and the other side wall.

The present invention provides a first process for producing a heat exchanger characterized by preparing a plurality of tacked metal plates each from the third metal plate by bending the metal plate into the shape of a hairpin at the joint portion to form flat walls by the flat wall forming portions and one side wall by the joint portion, to butt the reinforcing wall forming portions and the side wall forming portion in corresponding mating pairs, to force the projection into the recess, to thereby prevent the projection from slipping out of the recess and to tack the metal plate as bent; preparing a pair of headers each having holes for inserting the tacked plates thereinto which holes are equal in number to the number of tacked plates and a plurality of fins; arranging the pair of headers as spaced apart, arranging the tacked plates in parallel at a spacing and inserting opposite ends of the tacked plates into the respective holes in the headers; disposing each of the fins between each pair of adjacent tacked plates; brazing the reinforcing wall forming portions and the side wall forming portions of each tacked plate in corresponding mating pairs, brazing the tacked plates to the headers and brazing the tacked plates to the fins at the same time.

The present invention provides a second process for producing a heat exchanger characterized by preparing a plurality of tacked metal plates each from the fourth metal plate by bending the metal plate into the shape of a hairpin at the joint portion to form flat walls by the flat wall forming portions and one side wall by the joint portion, to butt the reinforcing wall forming portions and the side wall forming portion in corresponding mating pairs, to fit the projection into the recess, to deform the subprojection so as to cause the subprojection to press a side face of the projection, to thereby prevent the projection from slipping out of the recess and to tack the metal plate as bent; preparing a pair of headers each having holes for inserting the tacked plates thereinto which holes are equal in number to the number of tacked plates and a plurality of fins; arranging the pair of headers as spaced apart, arranging the tacked plates in parallel at a spacing and inserting opposite ends of the tacked plates into the respective holes in the headers; disposing each of the fins between each pair of adjacent tacked plates; brazing the reinforcing wall forming portions and the side wall forming portions of each tacked plate in corresponding mating pairs, brazing the tacked plates to the headers and brazing the tacked plates to the fins at the same time.

With the first and second processes of the invention for producing heat exchangers, the metal plates for producing flat tubes are tacked as bent in fabricating the heat exchanger, so that the tacked plates are easy to handle, consequently facilitating the fabrication of the heat exchanger.

BRIEF DESCRIPTION OF THE DRAWINGS

FIG. 16 is a front view showing a condenser of the multiflow type for use in motor vehicle air conditioners.

BEST MODE OF CARRYING OUT THE INVENTION

Figure 1:
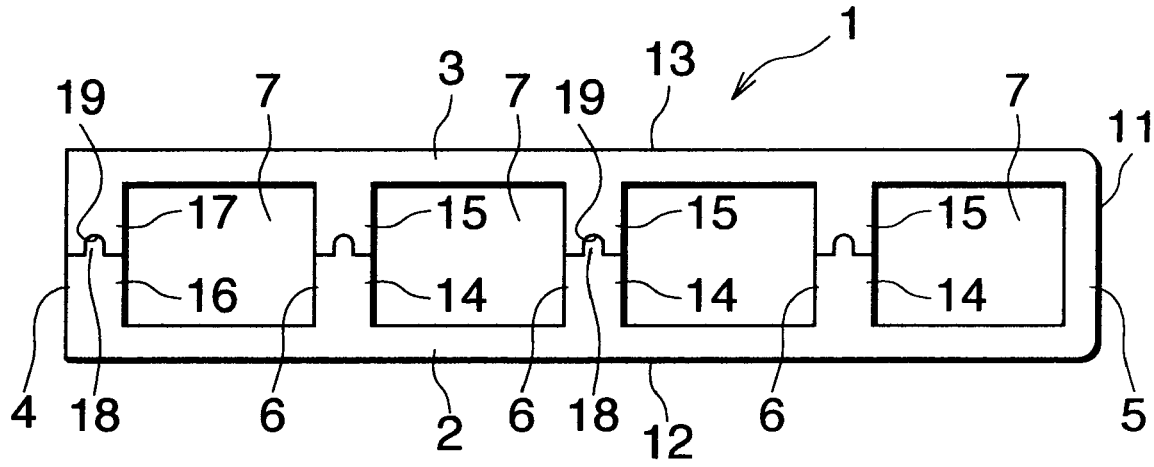
FIG. 1 is a front view showing an embodiment of flat tube according to the invention.

Embodiments of the present invention will be described below with reference to the drawings. Throughout the drawings, like parts are designated by like reference numerals and will not be described repeatedly.

Embodiment 1

Figure 2:
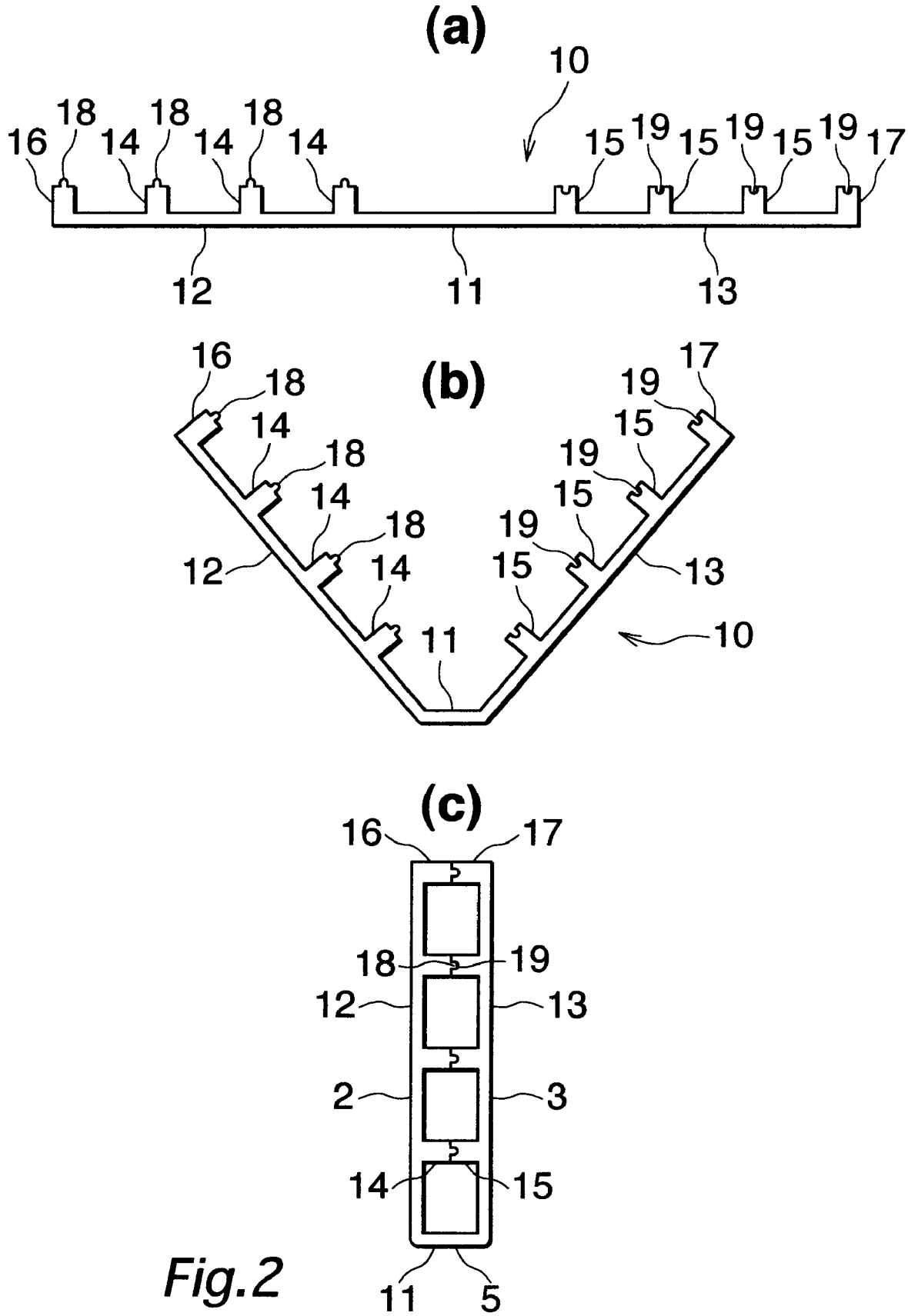
FIG. 2 shows a first specific example of process for producing the flat tube of the invention and includes front views showing the flat tube production process stepwise.
Figure 3:
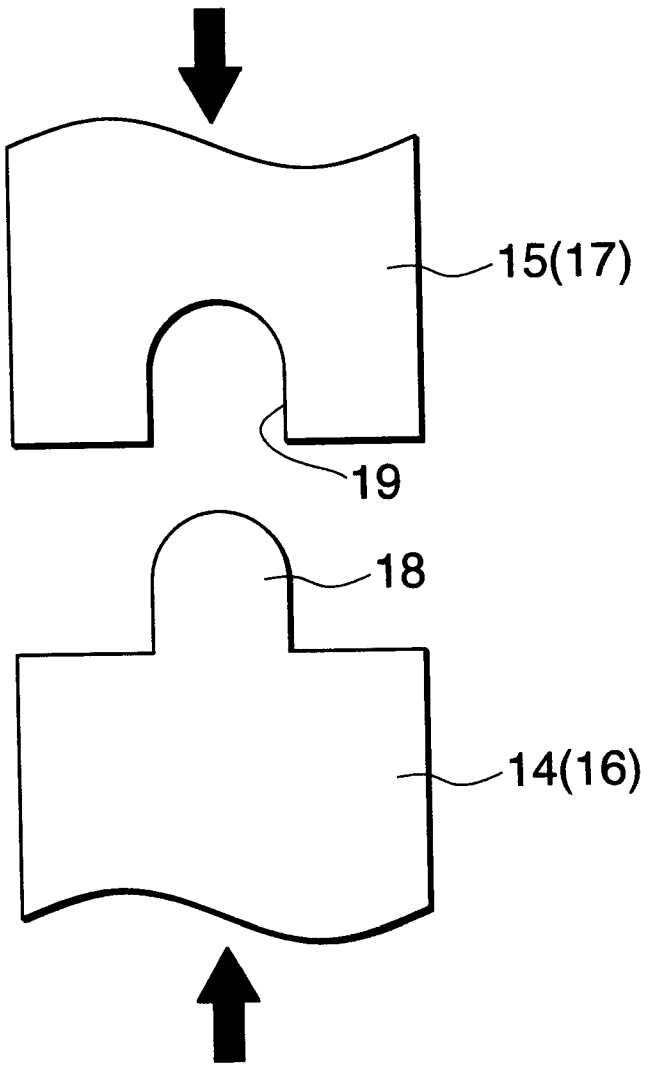
FIG. 3 is an enlarged fragmentary front view showing fitting of a ridge into a groove in the flat tube production process shown in FIG. 2.

This embodiment is shown in FIGS. 1 to 3.

FIG. 1 shows a flat tube.

With reference to FIG. 1, the flat tube 1 is made from aluminum and comprises a pair of flat walls 2, 3 opposed to each other, two side walls 4, 5 interconnecting opposite side edges of the two flat walls 2, 3, and a plurality of reinforcing walls 6 interconnecting the flat walls 2, 3, extending longitudinally of the tube 1 and spaced apart from one another by a predetermined distance. The tube has parallel fluid channels 7 in its interior.

FIG. 2(*a*) shows a metal plate for producing the flat tube.

With reference to FIG. 2(*a*), the metal plate 10 for producing the flat tube is prepared from an aluminum brazing sheet clad with a brazing material over opposite surfaces thereof, by passing the sheet between rolling rolls and thereby rolling the sheet. The metal plate 10 comprises two opposite flat wall forming portions 12, 13 connected together by a joint portion 11 at the midportion of its width, a plurality of, i.e., three, reinforcing wall forming portions 14 or 15 upwardly projecting from each of the wall forming portions 12, 13 integrally therewith and arranged laterally at a spacing, and side wall forming portions 16, 17 formed respectively at opposite side edges of the plate 10 integrally therewith and upwardly projecting therefrom. The reinforcing wall forming portions 14, 15 and side wall forming portions 16, 17 are formed over the entire length of the metal plate 10. The reinforming wall forming portions 14 on the flat wall forming portion 12 on the left side and the reinforming wall forming portions 15 on the flat wall forming portion 13 on the right side are symmetric about the longitudinal center line of the plate 10 and integral with the plate. The reinforcing wall portions 14, 15 and side wall portions 16, 17 are formed on one surface of an aluminum brazing sheet which is clad with a brazing material over opposite surfaces thereof, whereby a brazing material layer (not shown) is formed over the upper surfaces of the flat wall portions 12, 13 including opposite sides surfaces of the wall forming portions 14, 15, 16, 17 and the lower surfaces of the flat wall portions 12, 13. A brazing material layer of greater thickness is formed on the upper end faces of the wall forming portions 14, 15, 16, 17 than on the other portions.

The reinforcing wall forming portions 14 of the left flat wall forming portion 12 and the side wall forming portion 16 at the left side edge thereof are each provided at the upper end thereof with a ridge 18 (projection) extending longitudinally of the wall forming portions 14, 16 over the entire length thereof. The reinforcing wall forming portions 15 of the right flat wall forming portion 13 and the side wall forming portion 17 at the right side edge thereof are each provided at the upper end thereof with a groove 19 (recess) extending longitudinally of the wall forming portions 15, 17 over the entire length thereof for fitting the ridge 18 thereinto. The shape and area of the ridge 18 in section along a plane perpendicular to the wall forming portion 14 or 16 are the same as the shape and area of the groove 19 in section along a plane perpendicular to the wall forming portion 15 or 17 (see FIG. 3). The ridges 18 and the grooves 19 are formed when the aluminum brazing sheet is rolled. The top end face and side faces of each ridge 18 and the bottom face and side faces defining each groove 19 are also each provided with a brazing material layer.

The flat tube 1 is produced in the following manner.

First, the metal plate 10 is bent into a V shape at opposite side edges of the joint portion 11 by roll forming [see FIG. 2(*b*)], and further bent into the shape of a hairpin to form flat walls 2, 3 by the wall forming portions 12, 13 and one of side walls, 5, by the joint portion 11, to butt the reinforcing wall forming portions 14, 15 and the side wall forming portions 16, 17 in corresponding relation, and to intimately fit the ridges 18 of the reinforcing wall portions 14 and the left side wall forming portion 16 on the left flat wall forming portion 12 into the respective grooves 19 in the reinforcing wall portions 15 and the right side wall forming portion 17 on the right flat wall forming portion 13 [see FIG. 2(*c*) and FIG. 3].

The bent plate is thereafter heated at a predetermined temperature while pressing the flat wall forming portions 12, 13 against each other to braze the wall forming portions 14, 15, 16, 17 in corresponding relation to form reinforcing walls 6 and the other side wall 4. In this way, the flat tube 1 is fabricated. During the application of pressure, the fitting of the ridges 18 in the grooves 19 prevents displacement of each reinforcing wall forming portion 14 from the corresponding portion 15 and displacement of the side wall forming portions 16, 17 from each other in the direction of thickness, i.e., widthwise of the flat wall forming portions 12, 13. Accordingly, when the bent plate is brazed in this state, each mating pair of reinforcing wall forming portions 14, 15, as well as the side wall forming portions 16, 17, can be reliably brazed over the entire length, with the result that the flat tube 1 obtained is given exceedingly high pressure resistance.

In the case where the flat tube 1 is used, for example, as the refrigerant flow tube 112 for the condenser shown in FIG. 16, such flat tubes 1 may be produced simultaneously with the fabrication of the condenser. When the metal plate 10 is bent into the shape of a hairpin to thereby position the reinforcing wall forming portions 14, 15, as well as the side wall forming portions 16, 17, end-to-end in corresponding relation, with the ridges 18 intimately fitted in the respective grooves 19, the resulting plate is tacked by suitable means. A plurality of such tacked plates are prepared. Further prepared are a pair of headers 110, 111 each having holes for inserting the tacked plates thereinto which holes are equal in number to the number of tacked plates, and a plurality of corrugated fins 113. The pair of headers 110, 111 are then spaced apart, the tacked plates are arranged in parallel at a spacing, and the opposite ends of the tacked plates are inserted into the respective holes in the headers 110, 111. The corrugated fin 113 is disposed between each pair of adjacent tacked plates. The resulting assembly is heated at a specified temperature, whereby the reinforcing wall forming portions 14, 15 and the side wall forming portions 16, 17 of each tacked plate are brazed in corresponding pairs, the tacked plates are brazed to the headers 110, 111 and these plates are brazed to the corrugated fins 113 at the same time, utilizing the brazing materials layers of the metal plates 10. In this way, flat tubes 1 are produced simultaneously with the condenser.

Embodiment 2

Figure 6:
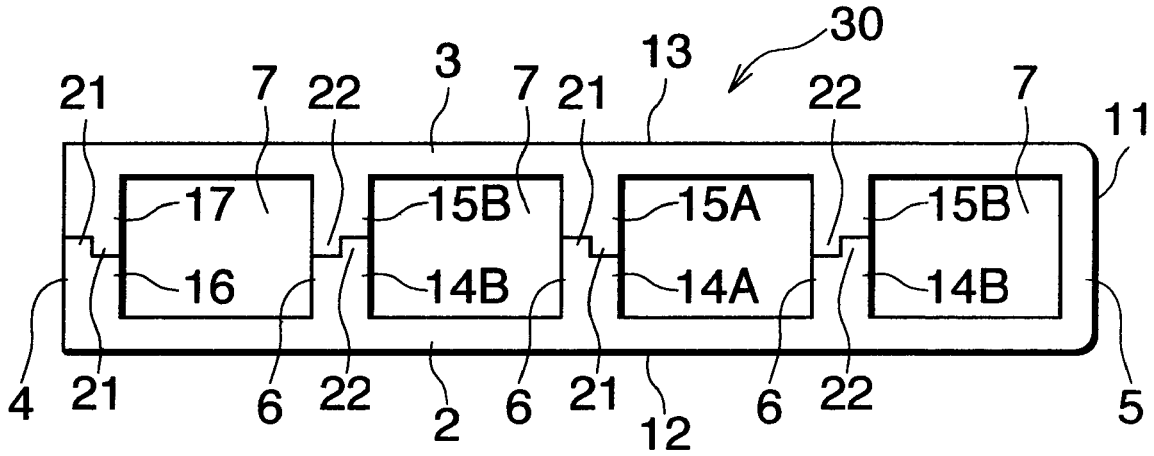
FIG. 6 shows a second embodiment of flat tube and is a front view of the flat tube to be produced by the process shown in FIG. 4.
Figure 5:
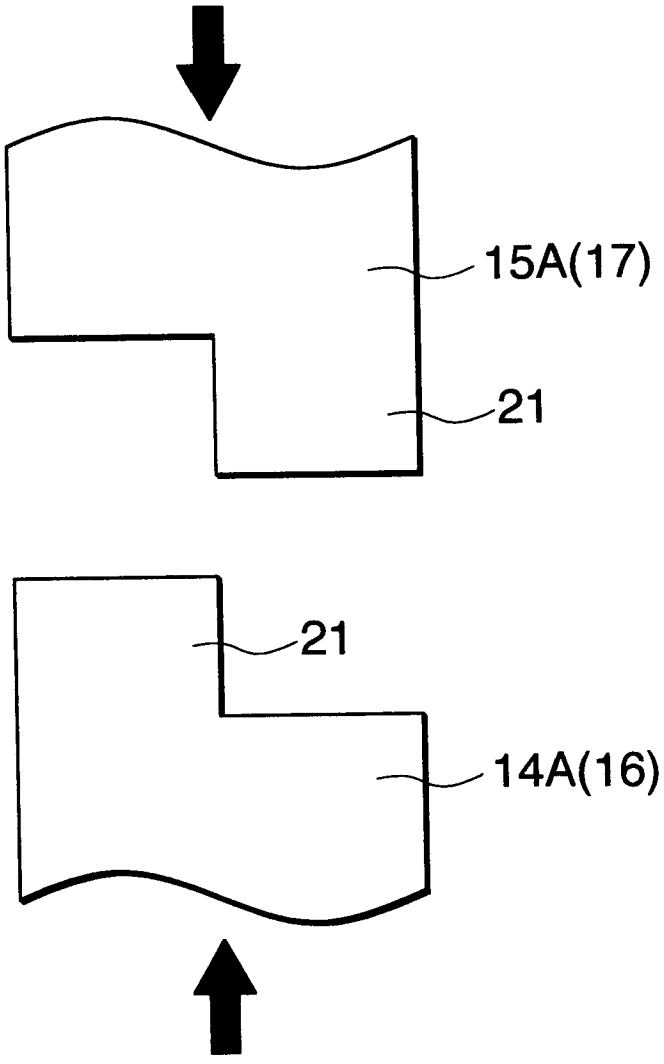
FIG. 5 is an enlarged fragmentary front view showing engagement of engaging ridges with each other in the flat tube production process shown in FIG. 4.
Figure 4:
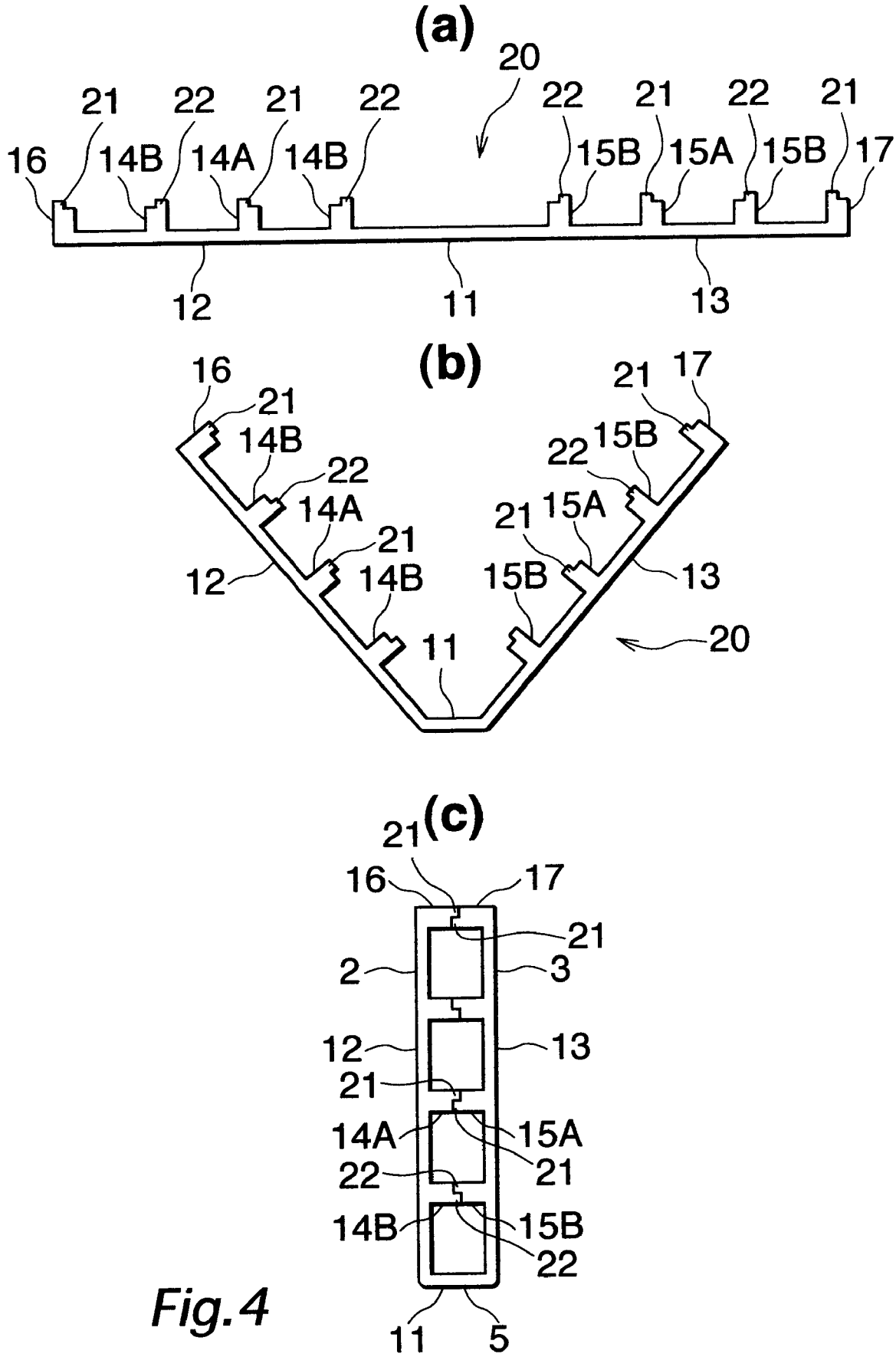
FIG. 4 includes front views showing stepwise a second specific example of process for producing a flat tube of the invention.

This embodiment is shown in FIGS. 4 to 6.

FIG. 4(*a*) shows a metal plate for producing a flat tube 30 shown in FIG. 6.

With reference to FIG. 4(*a*), the metal plate 20 for producing the flat tube is prepared from an aluminum brazing sheet clad with a brazing material over opposite surfaces thereof, by passing the sheet between rolling rolls and thereby rolling the sheet. At least one of three reinforcing wall forming portions on a left flat wall forming portion 12, i.e., the reinforcing wall forming portion 14A in the lateral midportion thereof, is integrally provided, at the left portion of its upper end, with a left engaging ridge 21 extending over the entire length of the portion 14A longitudinally thereof. The remaining reinforcing wall forming portions of the three on the left flat wall forming portion 12, i.e., the reinforcing wall forming portions 14B at the left and right sides thereof, are each integrally provided, at the right portion of the upper end thereof, with a right engaging ridge 22 extending over the entire length of the portion 14B longitudinally thereof. A side wall forming portion 16 at the left side edge of the portion 12 is integrally provided, at the left portion of its upper end, with a left engaging ridge 21 extending over the entire length of the portion 16 longitudinally thereof.

A reinforcing wall forming portion 15A positioned in the lateral midportion of a right flat wall forming portion 13 of the metal plate 20 and to be butted against the reinforcing wall portion 14A is integrally provided, at the left portion of its upper end, with a left engaging ridge 21 extending over the entire length of the portion 15A longitudinally thereof. Reinforcing wall forming portions 15B positioned on the right flat wall forming portion 13 at the left and right sides thereof and to be butted against the reinforcing wall portions 14B are each integrally provided, at the right portion of the upper end thereof, with a right engaging ridge 22 extending over the entire length of the portion 15B longitudinally thereof. A side wall forming portion 17 at the left side edge of the portion 13 is integrally provided, at the left portion of its upper end, with a left engaging ridge 21 extending over the entire length of the portion 17 longitudinally thereof.

In the case of the present embodiment also, a brazing material layer (not shown) is formed over the upper surfaces of the flat wall portions 12, 13 including opposite sides surfaces of the wall forming portions 14A, 14B, 15A, 15B, 16, 17 and the lower surfaces of the flat wall portions 12, 13. A brazing material layer of greater thickness is formed on the upper end faces of the wall forming portions 14A, 14B, 15A, 15B, 16, 17 than on the other portions. The engaging ridges 21, 22 described are formed simultaneously when the aluminum brazing sheet is rolled. The top end faces and side faces of the ridges 21, 22 are also each provided with a brazing material layer.

The flat tube 30 is produced in the following manner.

First, the metal plate 20 is bent into a V shape at opposite side edges of the joint portion 11 by roll forming [see FIG. 4(*b*)], and further bent into the shape of a hairpin to form flat walls 2, 3 by the wall forming portions 12, 13 and one of side walls, 5, by the joint portion 11, to butt the reinforcing wall forming portions 14A, 14B, 15A, 15B and the side wall forming portions 16, 17 in corresponding relation in mating pairs, and to engage in a meshing manner the ridges 21, 22 of the reinforcing wall portions 14A, 14B, 15A, 15B and the ridges 21, 22 of the side wall forming portions 16, 17 at the left and right side edges in mating pairs [see FIG. 4(*c*) and FIG. 5].

The reinforcing wall forming portions 14A, 14B, 15A, 15B are thereafter brazed in corresponding mating pairs, with the side wall forming portions brazed to each other, while pressing the flat wall forming portions 12, 13 toward each other to form reinforcing walls 6 and the other side wall 4. In this way, the flat tube 30 is fabricated (see FIG. 6). During the application of pressure, the engagement of the ridges 21, 22 in corresponding pairs prevents displacement of each of the reinforcing wall forming portions 14A, 14B, 15A, 15B from the corresponding portion of the pair and displacement of the side wall forming portions 16, 17 from each other in the direction of thickness, i.e., widthwise of the flat wall forming portions 12, 13. Accordingly, when the bent plate is brazed in this state, each mating pair of reinforcing wall forming portions 14A, 14B, 15A, 15B, as well as the side wall forming portions 16, 17, can be reliably brazed over the entire length, with the result that the flat tube 1 obtained is given exceedingly high pressure resistance.

Although the side wall forming portions 16, 17 at opposite side edges are also provided with engaging ridges 21, 22 according to the embodiment described, these portions 16, 17 need not always have the ridges 21, 22.

In the case where the flat tube 30 is used, for example, as the refrigerant flow tube of the condenser shown in FIG. 16, such flat tubes 30 may be fabricated simultaneously with the condenser by the same process as described with reference to Embodiment 1.

Embodiment 3

Figure 8:
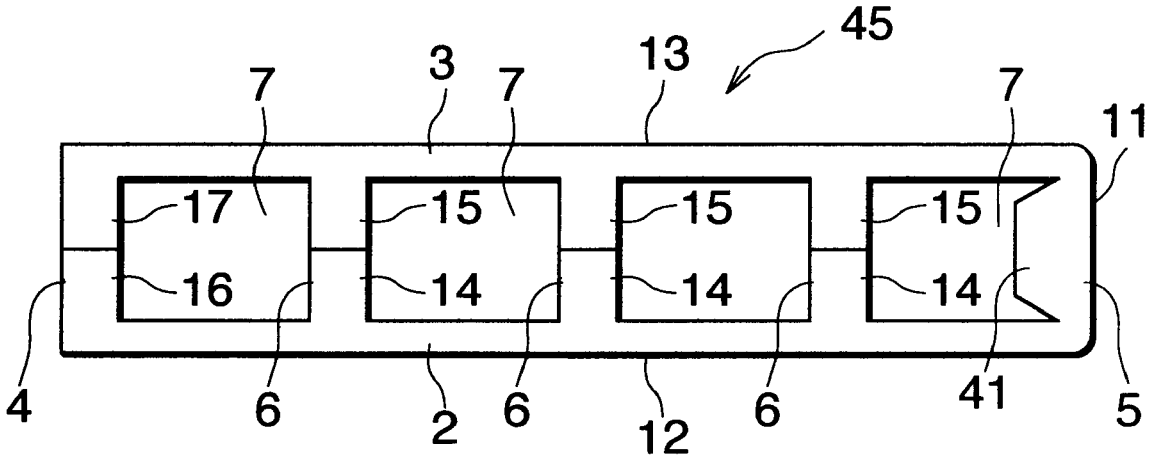
FIG. 8 shows a third embodiment of flat tube and is a front view of the flat tube to be produced by the process shown in FIG. 7.
Figure 7:
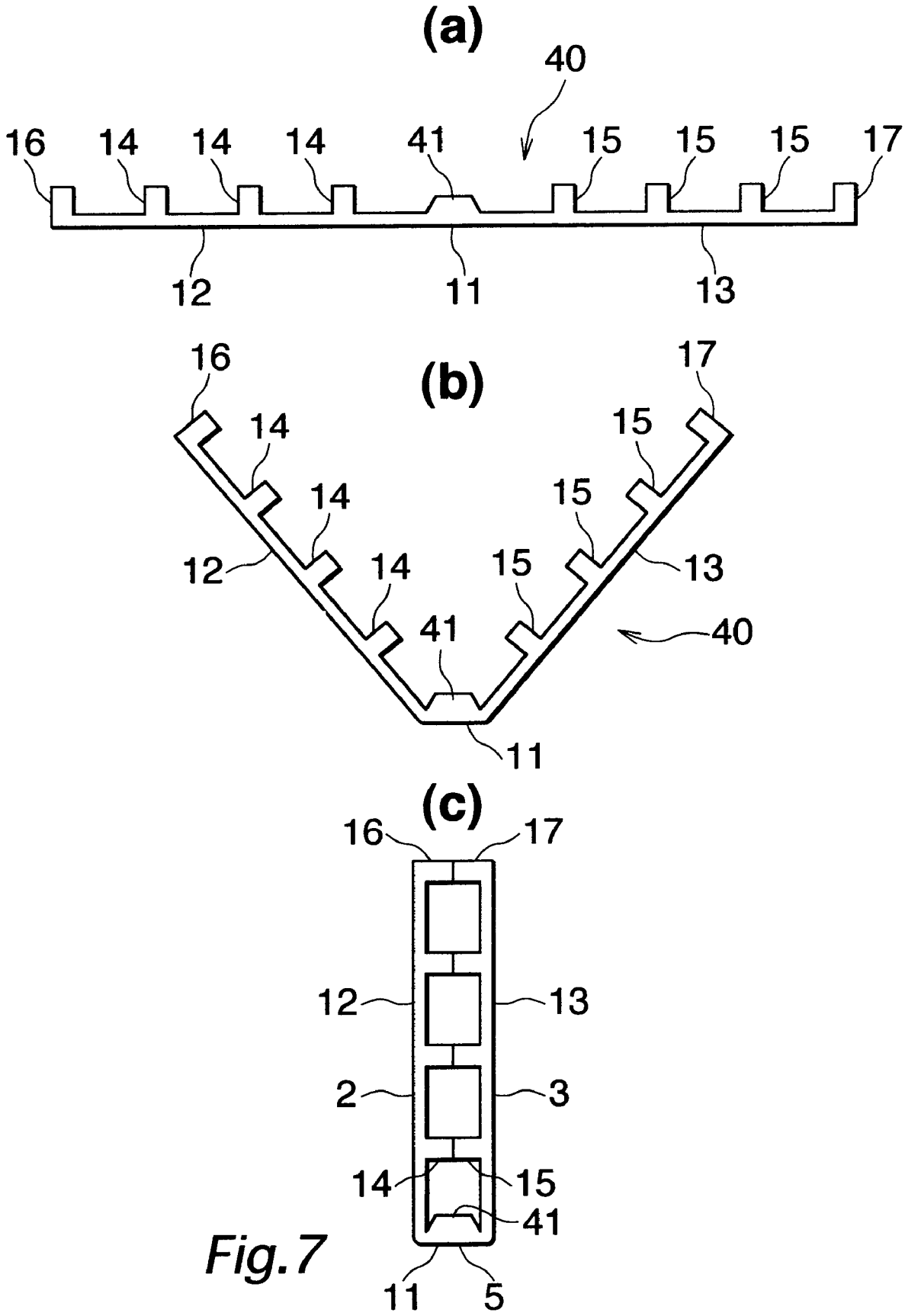
FIG. 7 includes front views showing stepwise a third specific example of process for producing a flat tube of the invention.

This embodiment is shown in FIGS. 7 and 8.

FIG. 7(*a*) shows a metal plate for producing a flat tube 45 shown in FIG. 8.

With reference to FIG. 7(*a*), the metal plate 40 for producing the flat tube is prepared from an aluminum brazing sheet clad with a brazing material over opposite surfaces thereof, by passing the sheet between rolling rolls and thereby rolling the sheet. Formed on the upper surface of a joint portion 11 integrally therewith is a ridge 41 having a trapezoidal cross section over the entire width of the portion 11 and extending over the entire length thereof, whereby the joint portion 11 is given a larger thickness than two flat wall forming portions 12, 13. The ridge 41 is formed simultaneously when the aluminum brazing sheet is rolled. In the case of this embodiment also, a brazing material layer (not shown) is formed over the upper surfaces of the flat wall portions 12, 13 including opposite sides surfaces of reinforcing wall forming portions 14, 15 and side wall forming portions 16, 17 and the lower surfaces of the flat wall portions 12, 13. A brazing material layer of greater thickness is formed on the upper end faces of the wall forming portions 14, 15, 16, 17 than on the other portions.

The flat tube 45 is produced in the following manner.

First, the metal plate 40 is bent into a V shape at opposite side edges of the joint portion 11 by roll forming [see FIG. 7(*b*)], and further bent into the shape of a hairpin to form flat walls 2, 3 by the wall forming portions 12, 13 and one of side walls, 5, by the joint portion 11 and to butt the reinforcing wall forming portions 14, 15 and the side wall forming portions 16, 17 in corresponding relation in mating pairs [see FIG. 7(*c*)].

The reinforcing wall forming portions 14, 15 are thereafter brazed in corresponding pairs, with the side wall forming portions 16, 17 brazed to each other while pressing the flat wall forming portions 12, 13 toward each other to form reinforcing walls 6 and the other side wall 4. In this way, the flat tube 45 is fabricated (see FIG. 8).

When the metal plate 40 is bent, the joint portion 11 of increased thickness so functions that the plate can be bent accurately, permitting the wall forming portions 14, 15, 16, 17 to be butted reliably in corresponding or mating pairs. Further during the application of pressure, the joint portion 11 of increased thickness prevents displacement of each of the reinforcing wall forming portions 14, 15 from the corresponding portion of the pair and displacement of the side wall forming portions 16, 17 from each other in the direction of thickness, i.e., widthwise of the flat wall forming portions 12, 13. Accordingly, when the bent plate is brazed in this state, each mating pair of reinforcing wall forming portions 14, 15, as well as the side wall forming portions 16, 17, can be reliably brazed over the entire length, with the result that the flat tube 45 obtained is given exceedingly high pressure resistance.

In the case where the flat tube 45 is used, for example, as the refrigerant flow tube of the condenser shown in FIG. 16, such flat tubes 45 are fabricated simultaneously with the condenser by the same process as described with reference to Embodiment 1.

Embodiment 4

Figure 9:
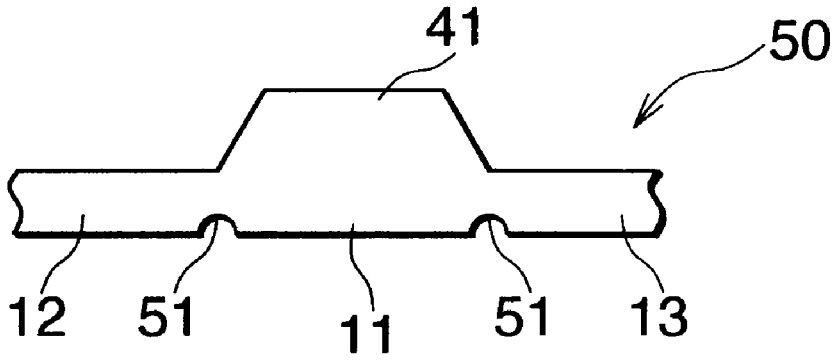
FIG. 9 is an enlarge fragmentary front view showing an embodiment of metal plate for producing a flat tube.

This embodiment is shown in FIG. 9.

A metal plate 50 for producing the flat tube is prepared from an aluminum brazing sheet clad with a brazing material over opposite surfaces thereof, by passing the sheet between rolling rolls and thereby rolling the sheet. According to this embodiment, the metal plate 50 is provided in its lower surface with a score 51 circular-arc in cross section, extending over the entire length thereof and positioned at each of boundaries between a joint portion 11 and two flat wall forming portions 12, 13. With the exception of this feature, the present embodiment has the same construction as Embodiment 3.

When the metal plate 50 is bent in the present case, the joint portion 11 of increased thickness and the scores 51 so function that the plate can be bent with high accuracy, permitting reinforcing wall forming portions 14, to be reliably butted in mating pairs, with side wall forming portions 16, 17 similarly butted against each other.

Embodiment 5

Figure 10:
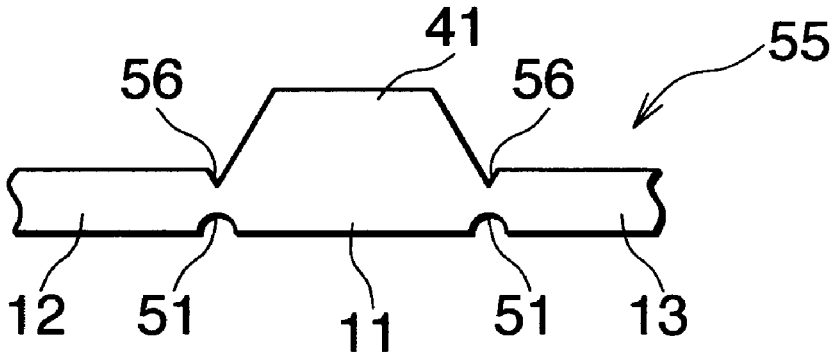
FIG. 10 is an enlarged fragmentary front view showing another embodiment of metal plate for producing a flat tube.

This embodiment is shown in FIG. 10.

A metal plate 55 for producing the flat tube is prepared from an aluminum brazing sheet clad with a brazing material over opposite surfaces thereof, by passing the sheet between rolling rolls and thereby rolling the sheet. According to this embodiment, the metal plate 55 is provided in its upper surface with a score 56 V-shaped in cross section, extending over the entire length thereof and positioned at each of boundaries between a joint portion 11 and two flat wall forming portions 12, 13. With the exception of this feature, the present embodiment has the same construction as Embodiment 4 described.

When the metal plate 55 is bent in the present case, the joint portion 11 of increased thickness and the scores 56, 51 in the plate upper and lower surfaces so function that the plate can be bent with high accuracy, permitting reinforcing wall forming portions 14, 15 to be reliably butted in mating pairs, with side wall forming portions 16, 17 similarly butted against each other.

Embodiment 6

Figure 11:
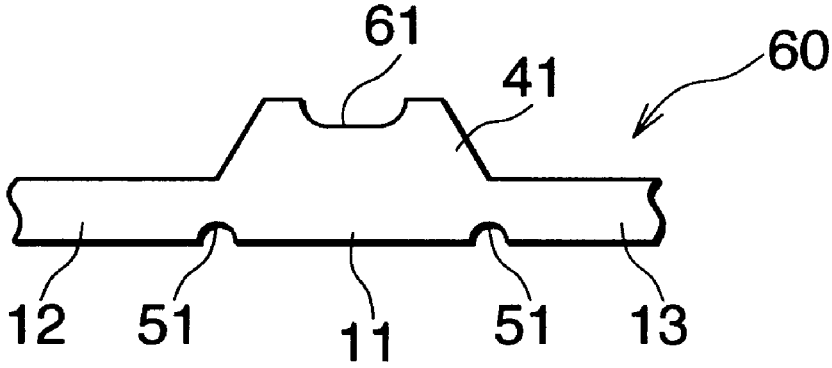
FIG. 11 is an enlarged fragmentary front view showing another embodiment of metal plate for producing a flat tube.

This embodiment is shown in FIG. 11.

A metal plate 60 for producing the flat tube is prepared from an aluminum brazing sheet clad with a brazing material over opposite surfaces thereof, by passing the sheet between rolling rolls and thereby rolling the sheet. According to this embodiment, the metal plate 60 has a ridge 41, i.e., a joint portion 11 of increased thickness, which is provided in its upper surface a furrow 61 extending longitudinally of the portion 11 over the entire length thereof. With the exception of this feature, the present embodiment has the same construction as Embodiment 4 described.

When the metal plate 60 is bent in the present case, the joint portion 11 of increased thickness, the scores 51 and the furrow 61 so function that the plate can be bent with high accuracy, permitting reinforcing wall forming portions 14, 15 to be reliably butted in mating pairs, with side wall forming portions 16, 17 similarly butted against each other.

Embodiment 7

This embodiment is shown in FIGS. 12 to 15.

Figure 12:
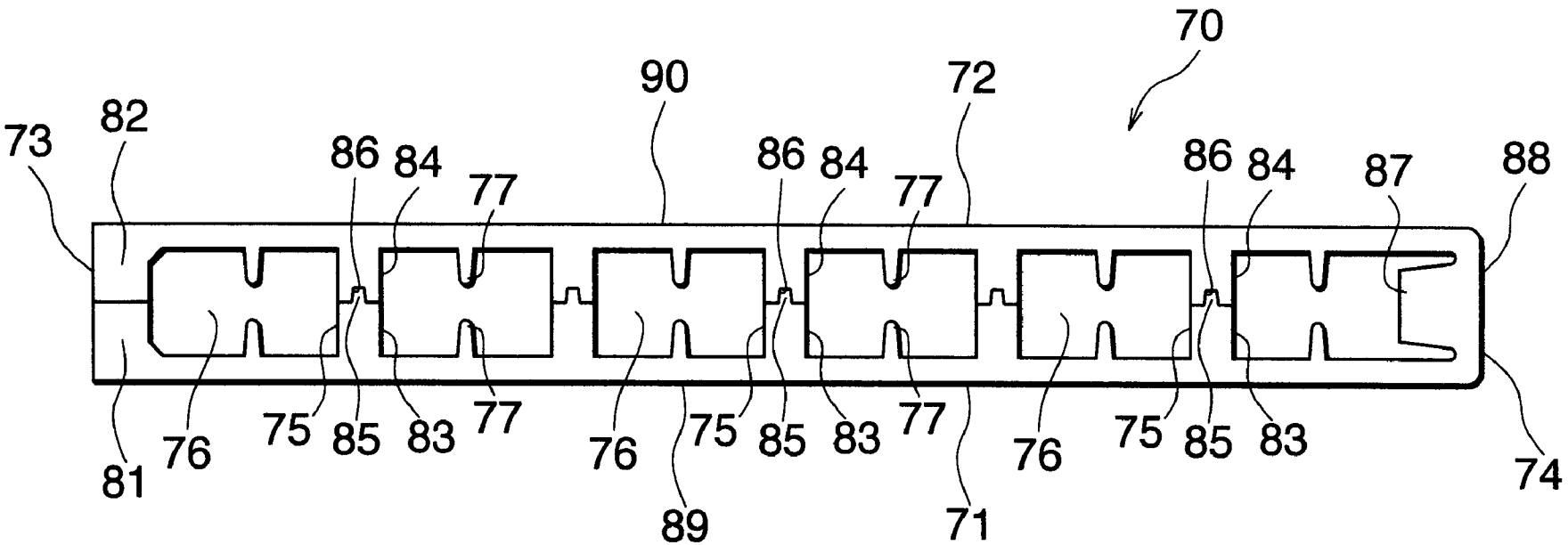
FIG. 12 is a front view showing a fourth embodiment of flat tube of the invention.

FIG. 12 shows a flat tube.

With reference to FIG. 12, the flat tube 70 is made from aluminum and comprises a pair of flat walls 71, 72 opposed to each other, two side walls 73, 74 interconnecting opposite side edges of the two flat walls 71, 72, and a plurality of reinforcing walls 75 interconnecting the flat walls 71, 72, extending longitudinally of the tube 1 and spaced apart from one another by a predetermined distance. The tube has parallel fluid channels 76 in its interior.

The portion of inner surface of each of the flat walls 71, 72 defining the fluid channel 76 between the adjacent reinforcing walls 75 has a plurality of protrusions 77 inwardly projecting from the flat wall integrally therewith and spaced apart longitudinally thereof. The reinforcing walls 75 each have a plurality of communication holes (not shown) arranged at a spacing longitudinally thereof for causing the parallel fluid channels 76 to communicate with one another therethrough. All the communication holes (not shown) are in a staggered arrangement when seen from above.

The left side wall 73 is formed by brazing side wall forming portions 81, 82 formed on the respective flat walls 71, 72 integrally therewith, as positioned end-to-end, and the reinforcing walls 75 are formed by brazing reinforcing wall forming portions 83, 84 formed on the respective flat walls 71, 72 integrally therewith, as positioned end-to-end in corresponding pairs. A projection 85 is formed on the upper end of each reinforcing wall forming portion 83 on the flat wall 71, while a recess 86 for the projection 85 to fit in is formed in the upper end of each reinforcing wall forming portion 84 on the other flat wall 72. The reinforcing wall forming portions 83, 84 are brazed end-to-end, with the projection 85 forced into the recess 86.

Formed on the inner surface of the right side wall 74 integrally therewith is a ridge 87 having a trapezoidal cross section over the approximately entire width of the wall 74 and extending over the entire length of the side wall 74.

Figure 13:
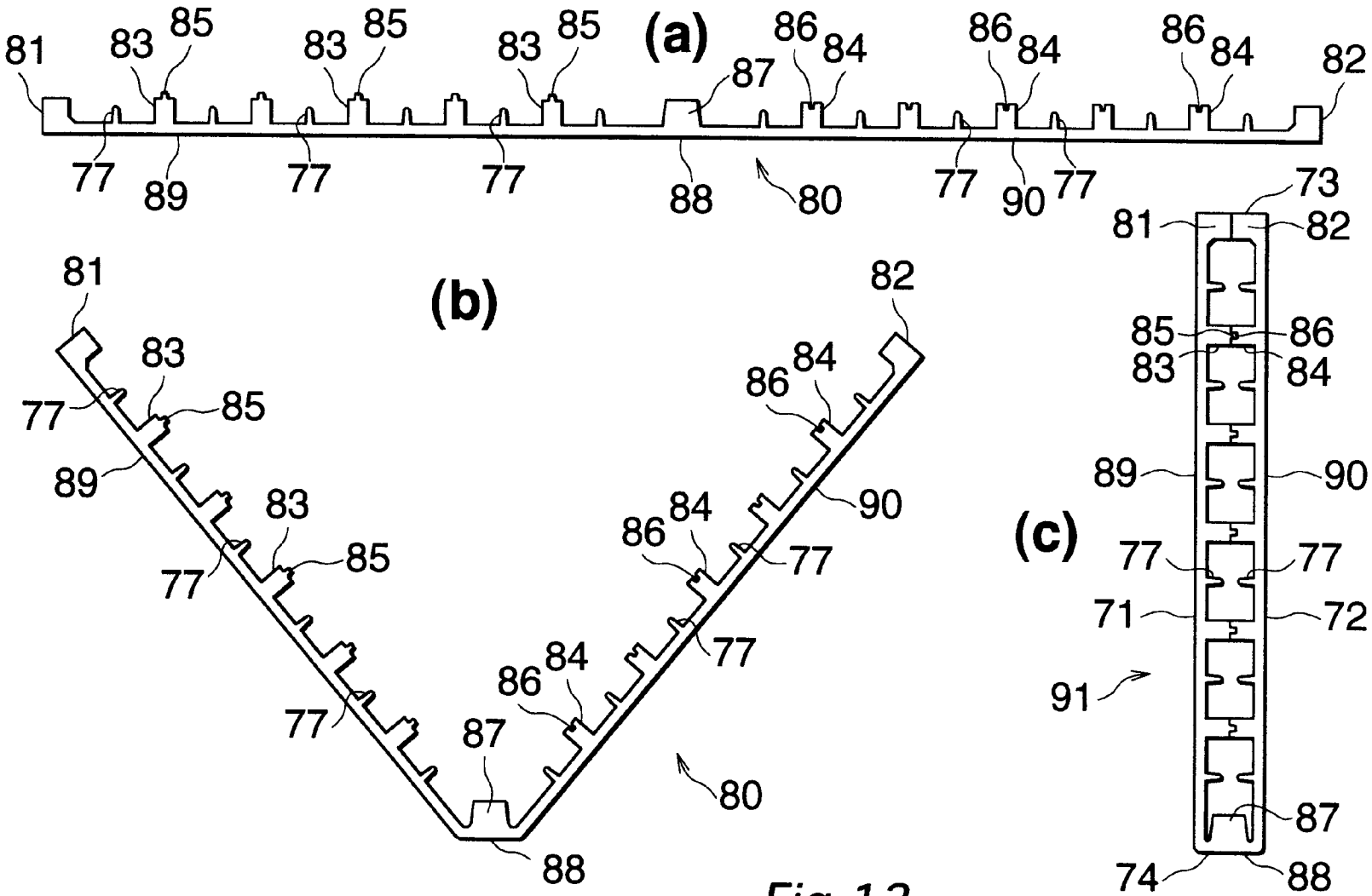
FIG. 13 shows a fourth specific example of process for producing the flat tube of the invention and includes front views showing stepwise the process for producing the flat tube of FIG. 12.

FIG. 13(*a*) shows a metal plate for use in producing the flat tube 70.

With reference to FIG. 13(*a*), the metal plate 80 for producing the flat tube is prepared from an aluminum brazing sheet clad with a brazing material over opposite surfaces thereof, by passing the sheet between rolling rolls and thereby rolling the sheet. The metal plate 80 comprises two opposite flat wall forming portions 89, 90 connected together by a joint portion 88 at the midportion of its width. The left flat wall forming portion 89 has a side wall forming portion 81 upwardly projecting from the left side edge of this portion 89 integrally therewith and extending over the entire length thereof, and a plurality of reinforcing wall forming portions 83 positioned rightwardly of the side wall portion 81, upwardly projecting from the flat wall portion 89 integrally therewith, arranged laterally at a spacing and extending over the entire length of the flat wall portion 89. The right flat wall forming portion 90 has a side wall forming portion 82 upwardly projecting from the right side edge of this portion 90 integrally therewith and extending over the entire length thereof, and a plurality of reinforcing wall forming portions 84 positioned leftwardly of the side wall portion 82, upwardly projecting from the flat wall portion 90 integrally therewith, arranged laterally at a spacing and extending over the entire length of the flat wall portion 90. The reinforming wall forming portions 83 on the left flat wall portion 89 and the reinforming wall forming portions 84 on the right flat wall portion 90 are symmetric about the longitudinal center line of the plate 80 and integral with the plate. The side wall forming portions 81, 82 and the reinforcing wall portions 83, 84 and are formed on one surface of an aluminum brazing sheet which is clad with a brazing material over opposite surfaces thereof, whereby a brazing material layer (not shown) is formed over the upper surfaces of the flat wall portions 89, 90 including opposite sides surfaces of the wall forming portions 81, 82, 83, 84 and the lower surfaces of the flat wall portions 89, 90. A brazing material layer of greater thickness is formed on the upper end faces of the wall forming portions 81, 82, 83, 84 than on the other portions.

The flat wall portions 89, 90 further have protrusions 77 formed between the side wall portion 81 or 82 and the reinforcing wall portion 83 or 84, between the reinforcing wall portion 83 or 84 and the joint portion 88, and between the adjacent reinforcing wall portions 83 or 84, upwardly projecting from the flat wall portion 89 or 90 integrally therewith and spaced apart longitudinally the portion 89 or 90.

Formed on the upper surface of the joint portion 88 integrally therewith is a ridge 87 having a trapezoidal cross section over the approximately entire width thereof in an upwardly projecting form and extending over the entire length of this portion 88, whereby the joint portion 88 is given a greater wall thickness than the flat wall portions 89, 90.

A projection 85 is formed on the upper end of each reinforcing wall forming portion 83 on the left flat wall forming portion 89, and a recess 86 for the projection 85 to fit in is formed in the upper end face of each reinforcing wall forming portion 84 on the right flat wall forming portion 90. Along a plane perpendicular to the longitudinal direction of the reinforcing wall portion 83, the projection 85 has a trapezoidal section decreasing in width toward its upper end. Along a plane perpendicular to the longitudinal direction of the reinforcing wall portion 84, the recess 86 has a trapezoidal section decreasing in width toward the bottom thereof (see [FIG. 14(*a*)]. The projections 85 and the recesses 86 are formed when the aluminum brazing sheet is rolled. Although not shown, a brazing material layer also covers the end face and opposite side faces of each projection 85 and the bottom face and side faces defining each recess 86.

Figure 14:
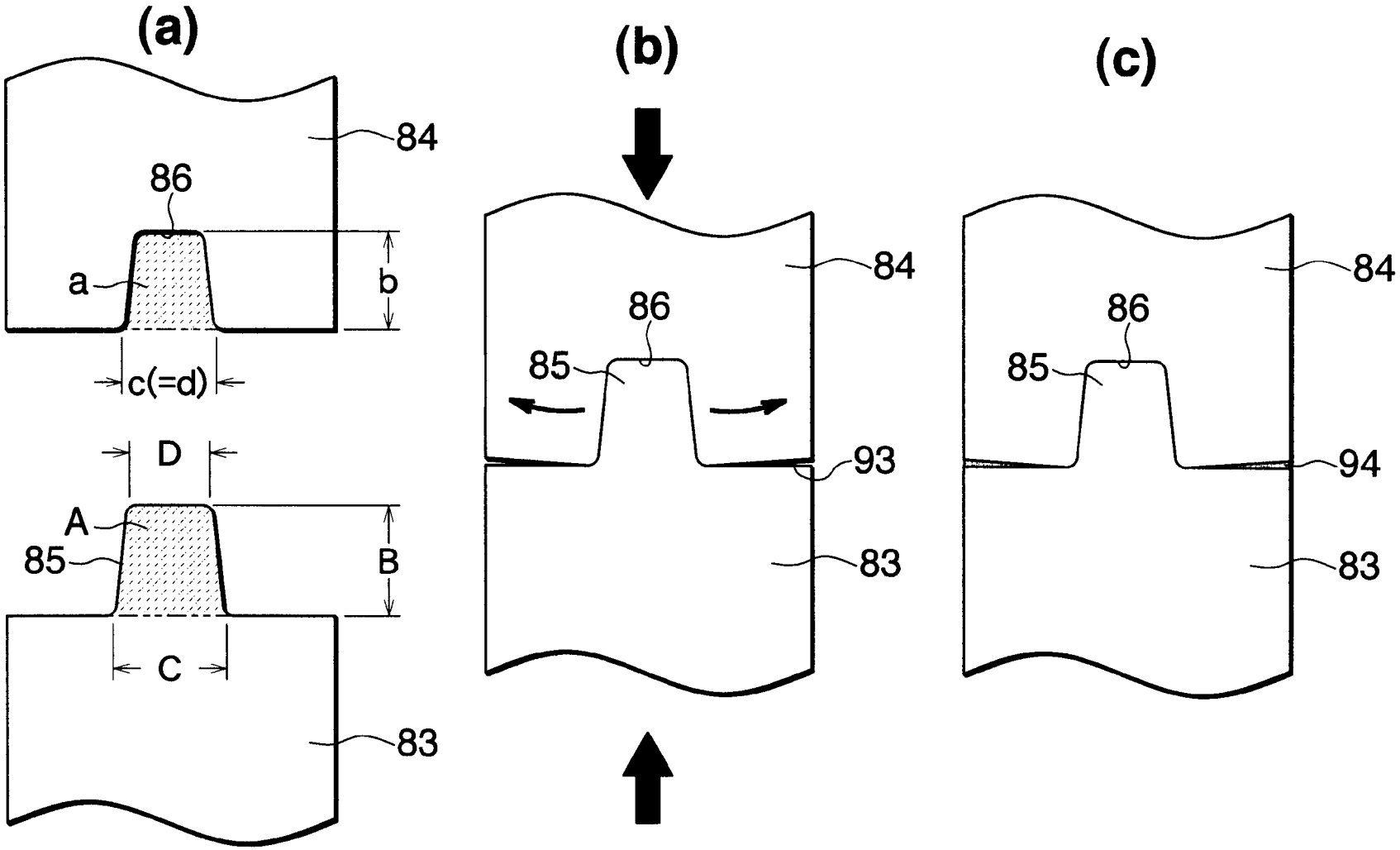
FIG. 14 includes enlarged fragmentary front views showing stepwise the process for producing the flat tube of FIG. 12.

The metal plate 80 satisfies the relationships of:

$$A>a,\ A/a\leqq 1.5,\ B/b\leqq 1.5,\ C/c-1.5,\ \text{and}\ D/d/\leqq 1.5$$

wherein as shown in FIG. 14(*a*), A is the cross sectional area [corresponding hatched portion shown in FIG. 14(*a*)] of the projection 85 in section along a plane perpendicular to the longitudinal direction of the reinforcing wall forming portion 83, B is the height of the projection 85, C is the maximum width of the projection 85 in the direction of thickness of the wall forming portion 83, D is the width of the upper end of the projection 85 in the direction of thickness of the wall forming portion 83, a is the cross sectional area [corresponding hatched portion shown in FIG. 14(*a*)] of the recess 86 in section along a plane perpendicular to the longitudinal direction of the reinforcing wall forming portion 84, b is the depth of the recess 86, c is the maximum width of the recess 86 in the direction of thickness of the wall forming portion 84, and d (=c) is the width of opening of the recess 86 in the direction of thickness of the wall forming portion 84.

The projection 85 and the recess 86, which are each one in number, may be formed in the respective wall forming portions 83, 84. Assuming that the projection 85 and the recess 86 are L1 in length and that the reinforcing wall forming portions 83, 84 are L in length in this case, these lengths satisfy the relationship of $0.01\leqq L1/L\leqq 1$.

The reinforcing wall forming portions 83, 84 may be provided with a plurality of projections 85 and a plurality of recesses 86, respectively, as arranged at a spacing longitudinally of the wall forming portion. Assuming that the combined length of all the projections 85 and all the recesses 86 is L2 and that the length of each of the reinforcing wall forming portions 83, 85 is L in this case, these lengths satisfy the relationship of $0.01\leqq L2/L$.

The flat tube 70 is produced in the following manner.

The metal plate 80 is bent into a V shape at opposite side edges of the joint portion 88 by roll forming [see FIG. 13(*b*)], and further bent into the shape of a hairpin to form flat walls 71, 72 by the flat wall forming portions 89, 90 and one of side walls, 74, by the joint portion 88, to butt the side wall forming portions 81, 82 and the reinforcing wall forming portions 83, 84 in corresponding relation in mating pairs and to force the projections 85 into the recesses 86. At this time, each projection 85 is slightly so deformed as to diminish in width, and the recess 86 is slightly so deformed as to enlarge in width as shown in FIG. 14(*b*), with the result that the frictional force between opposite side faces of the projection 85 and opposite side faces defining the recess 86 prevents the projection 85 from slipping out of the recess 86, making it possible to temporarily hold the metal plate 80 in a bent state and affording a tacked plate 91 [see FIG. 13(*c*)]. When the projection 85 is forced into the recess 86, the projection 85 and the recess 85 deform, with the result that a very small clearance 93 occurs between the opposed ends of the reinforcing wall forming portions 83, 84.

The tacked plate 91 is thereafter heated at a predetermined temperature to braze the side wall forming portions 81, 82 to each other, to braze the reinforcing wall forming portions 83, 84 in corresponding relation in mating pairs and to thereby form the other side wall 73 and reinforcing walls 75. In this way, the flat tube 70 is fabricated. The brazing operation fills up the clearance 93 between the opposed ends of each pair of reinforcing wall forming portions 83, 84 with a brazing material 94.

When pressure acts on the flat wall forming portions 89, 90 during brazing to bring these portions toward each other, the fitting of each projection 85 in the recess 86 prevents the side wall forming portions 81, 82 from being displaced from each other and each reinforcing wall forming portion 83 or 84 from being displaced from like portion 84 or 83 in pair, in the direction of thickness thereof, i.e., widthwise of the flat wall forming portions 89, 90. Accordingly when the tacked plate is brazed, the wall forming portions 81, 82, 83, 84 are reliably brazed in mating pairs over the entire length thereof to give greatly improved pressure resistance to the flat tube 70 obtained.

In the case where the flat tube 70 is used, for example, as the refrigerant flow tube 112 of the condenser shown in FIG. 16, such flat tubes 70 may be fabricated simultaneously with the condenser. More specifically, the condenser is fabricated in the following manner. First, a tacked plate 91 shown in FIG. 13(*c*) is prepared from a metal plate 80 in the manner already described. A plurality of such tacked plates 91 are prepared. Further prepared are a pair of headers 110, 111 each having holes for inserting the tacked plates 91 thereinto which holes are equal in number to the number of tacked plates 91, and a plurality of corrugated fins 113. The pair of headers 110, 111 are then spaced apart, the tacked plates 91 are arranged in parallel at a spacing, and the opposite ends of the tacked plates 91 are inserted into the respective holes in the headers 110, 111. The corrugated fin 113 is disposed between each pair of adjacent plates 91. The resulting assembly is heated at a specified temperature, whereby the side wall forming portions 81, 82 and the reinforcing wall forming portions 83, 84 of each tacked plate 91 are brazed in corresponding pairs, the tacked plates 91 are brazed to the headers 110, 111 and the plates 91 are brazed to the corrugated fins 113 at the same time, utilizing the brazing materials layers of the metal plates 80. In this way, a condenser is fabricated.

Next, Embodiment 7 will be described with reference to examples and comparative examples.

Examples 1-10 and Comparative Examples 1-8

Two plates, measuring 100 mm in length, 0.5 mm in thickness and 0.4 mm in height, were prepared from an aluminum material which was 70 kN/mm$^2$ in Young's modulus and 0.33 in Poisson's ratio. Formed on a side surface of one of the plates was a ridge positioned in the widthwise midportion thereof and extending over the entire length of the plate longitudinally thereof. Formed in a side surface of the other plate was a recess positioned in the widthwise midportion thereof and extending over the entire length of the plate longitudinally thereof. FIG. 14(*a*) shows the projection and the recess in a sectional form along a plane perpendicular to the length of the plate. The plate having the projection and the plate having the recess were used as a pair of test pieces. Thus, 18 pairs of test pieces were prepared. The plates had surfaces which were 0.3 in coefficient of friction.

Table 1 shows the values of A/a, B/b, C/c, D/d wherein A is the cross sectional area of the projection in section along a plane perpendicular to the longitudinal direction of the plate, B is the height of the projection, C is the maximum width of the projection in the direction of thickness of the plate, D is the width of the upper end of the projection in the direction of thickness of the plate, a is the cross sectional area of the recess in section along a plane perpendicular to the longitudinal direction of the plate, b is the depth of the recess, c is the maximum width of the recess in the direction of thickness of the plate, d is the width of an opening of the recess in the direction of thickness of the plate.

TABLE 1

| | Projection size mm | | | Recess size mm | | | Area mm$^2$ | | | | | | |
|---|---|---|---|---|---|---|---|---|---|---|---|---|---|
| | Height H | Width C | Width D | Depth b | Width c | Width d | A | a | A/a | B/b | C/c | D/d | Effect |
| Example 1 | 0.105 | 0.105 | 0.09 | 0.1 | 0.1 | 0.1 | 0.010238 | 0.01 | 1.02 | 1.05 | 1.05 | 0.90 | ○ |
| Example 2 | 0.11 | 0.11 | 0.09 | 0.1 | 0.1 | 0.1 | 0.011 | 0.01 | 1.10 | 1.10 | 1.10 | 0.90 | ○ |
| Example 3 | 0.15 | 0.11 | 0.09 | 0.1 | 0.1 | 0.1 | 0.015 | 0.01 | 1.50 | 1.50 | 1.10 | 0.90 | ○ |
| Example 4 | 0.2 | 0.12 | 0.09 | 0.135 | 0.105 | 0.105 | 0.021 | 0.014175 | 1.48 | 1.48 | 1.14 | 0.86 | ○ |
| Example 5 | 0.15 | 0.1 | 0.09 | 0.1 | 0.1 | 0.1 | 0.01425 | 0.01 | 1.43 | 1.50 | 1.00 | 0.90 | ○ |
| Example 6 | 0.1 | 0.15 | 0.09 | 0.1 | 0.1 | 0.1 | 0.012 | 0.01 | 1.20 | 1.00 | 1.50 | 0.90 | ○ |
| Example 7 | 0.1 | 0.12 | 0.12 | 0.1 | 0.08 | 0.08 | 0.012 | 0.008 | 1.50 | 1.00 | 1.50 | 1.50 | ○ |
| Example 8 | 0.095 | 0.1 | 0.09 | 0.1 | 0.08 | 0.08 | 0.009025 | 0.008 | 1.13 | 0.95 | 1.25 | 1.13 | ○ |
| Example 9 | 0.15 | 0.09 | 0.08 | 0.1 | 0.1 | 0.1 | 0.01275 | 0.01 | 1.28 | 1.50 | 0.90 | 0.80 | ○ |
| Example 10 | 0.11 | 0.15 | 0.135 | 0.1 | 0.15 | 0.15 | 0.015675 | 0.015 | 1.05 | 1.10 | 1.00 | 0.90 | ○ |
| Comp. Ex. 1 | 0.1 | 0.1 | 0.09 | 0.1 | 0.1 | 0.1 | 0.0095 | 0.01 | 0.95 | 1.00 | 1.00 | 0.90 | X |
| Comp. Ex. 2 | 0.1 | 0.1 | 0.09 | 0.11 | 0.11 | 0.11 | 0.0095 | 0.0121 | 0.79 | 0.91 | 0.91 | 0.82 | X |
| Comp. Ex. 3 | 0.2 | 0.1 | 0.09 | 0.115 | 0.105 | 0.105 | 0.019 | 0.012075 | 1.57 | 1.74 | 0.95 | 0.86 | X |
| Comp. Ex. 4 | 0.2 | 0.1 | 0.09 | 0.09 | 0.105 | 0.105 | 0.019 | 0.00945 | 2.01 | 2.22 | 0.95 | 0.86 | X |
| Comp. Ex. 5 | 0.155 | 0.1 | 0.09 | 0.1 | 0.1 | 0.1 | 0.014725 | 0.01 | 1.47 | 1.55 | 1.00 | 0.90 | X |
| Comp. Ex. 6 | 0.15 | 0.1 | 0.09 | 0.09 | 0.1 | 0.1 | 0.01425 | 0.009 | 1.58 | 1.67 | 1.00 | 0.90 | X |
| Comp. Ex. 7 | 0.1 | 0.155 | 0.09 | 0.1 | 0.1 | 0.1 | 0.01225 | 0.01 | 1.23 | 1.00 | 1.55 | 0.90 | X |
| Comp. Ex. 8 | 0.1 | 0.13 | 0.13 | 0.095 | 0.085 | 0.085 | 0.013 | 0.008075 | 1.61 | 1.05 | 1.53 | 1.53 | X |

The test pieces of each pair had their side surfaces brought into contact with each other, with the projection fitted into the recess. The pair of plates were then pulled apart for separation to check whether a force was necessary for separation. The result is given in the column of "Effect" in Table 1. With reference to this column of Table 1, the circle mark indicates that a predetermined force was required when the plates were pulled apart for separation, while the cross mark indicates that no force was needed for pulling the plates apart for separation.

The result listed in Table 1 shows that Examples 1 to 10 satisfying the relationships of A>a, A/a≦1.5, B/b≦1.5, C/c≦1.5, and D/d/≦1.5 required a force for removing the projection from the recess. This substantiates that when the projection and the recess are used for the metal plate for producing a flat tube, that is, when the metal plate 80 is bent into the shape of hairpin to butt the side wall forming portions 81, 82 and the reinforcing wall forming portions 83, 84 in corresponding relation or mating pairs and to force the projection 85 into the recess 86, the projection 85 can be prevented from slipping out of the recess 86. As a result, the metal plate 80 can be tacked as bent.

Embodiment 8

Figure 15:
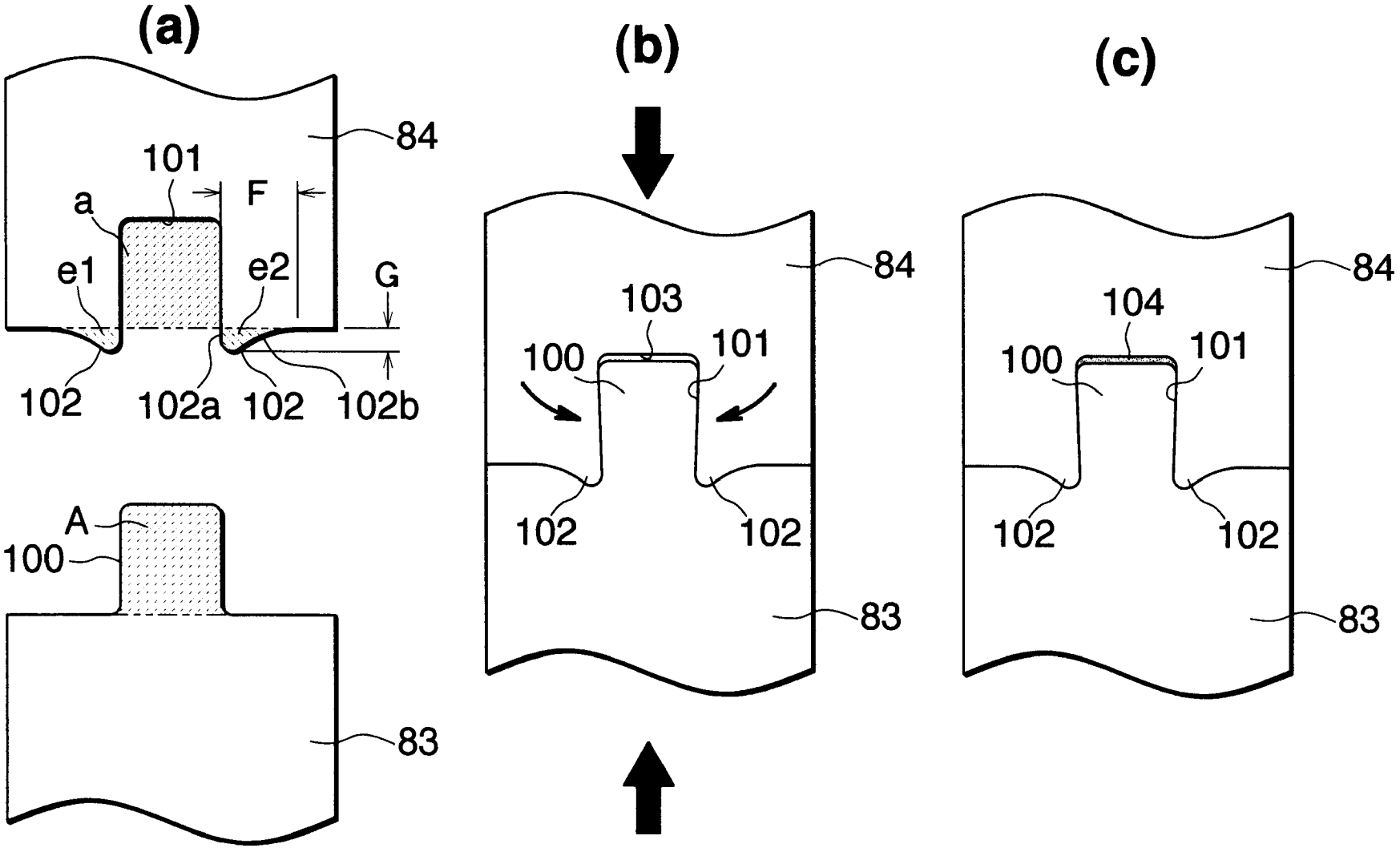
FIG. 15 includes views corresponding to those of FIG. 14 and showing a fifth specific example of process for producing a flat tube of the invention.

This embodiment is shown in FIG. 15.

The flat tube of this embodiment has the same construction as the flat tube of Embodiment 7 with the exception of the following as shown in FIG. 15(*c*). A projection 100 formed on the upper end of each reinforcing wall forming portion 83 and a recess 101 formed in the upper end of each reinforcing wall forming portion 84 are different from the projection 85 and recess 86 of Embodiment 7 in sectional shape along a plane perpendicular to the length of the reinforcing wall forming portion 83 or 84. The upper end of the reinforcing wall forming portion 84 having the recess 101 formed therein is integrally provided at opposite sides of the recess 101 with subprojections 102 for pressing opposite side faces of the projection 100 upon deformation when the projection 100 is fitted into the recess 101.

The metal plate of this embodiment for producing the flat tube differs from the metal plate of Embodiment 7 in that the projection 100 formed on the upper end of each reinforcing wall forming portion 83 of the left flat plate forming portion 89 and the recess 101 formed in the upper end of each reinforcing wall forming portion 84 of the right flat wall forming portion 90 are rectangular and identical in cross sectional shape and equal in cross sectional area, along a plane perpendicular to the length of the reinforcing wall forming portion 83 or 84 as shown in FIG. 15(*a*). The metal plate of this embodiment is different from the metal plate of Embodiment 7 further in that the upper end of each reinforcing wall forming portion 84 on the right flat wall forming portion 90 having the recess 101 formed therein is integrally provided at opposite sides of the recess 101 with subprojections 102 which deform when the projection 100 is fitted into the recess 101 to press opposite side faces of the projection 100. In cross section along a plane perpendicular to the longitudinal direction of the reinforcing wall forming portion 84, the subprojection 102 has a first part 102*a* continuous with the side face of the recessed portion 101, and a second part 102*b* extending from the outer end of the first part 102*a* and inclined toward the end face of the wall forming portion 84 in a direction away from the recess 101.

As in the case of Embodiment 7, the projections 100 and the recesses 101 are formed when the aluminum brazing sheet is rolled. Although not shown, a brazing material layer is provided over the end face and opposite side faces of each projection 100 and over the bottom face and opposite side faces defining each recess 101. The subprojections 102 are formed also when the aluminum brazing sheet is rolled. Although not shown, a brazing material layer is provided over the surfaces of the first part 102*a* and the second part 102*b* of each subprojection. One subprojection 102 is formed on each reinforcing wall forming portion 84, or a plurality of subprojections 102 are provided on the portion 84, as arranged at a spacing longitudinally thereof. In the case where one subprojection 102 is formed on each portion 84, the subprojection is not greater than the wall forming portion 84 in length. The upper end face of the reinforcing wall forming portion 83 having the projection 100 thereon may be provided at opposite sides of the projection 100 with subrecesses for the subprojections to fit in.

The metal plate of the present embodiment satisfies the relationship of 0.01≦E/(A+a)≦0.5 wherein A is the cross sectional area [corresponding hatched portion shown in FIG. 15(*a*)] of the projection 100 in section along a plane perpendicular to the longitudinal direction of the reinforcing wall forming portion 83, a is the cross sectional area [corresponding hatched portion shown in FIG. 15(*a*)] of the recess 101 in section along a plane perpendicular to the longitudinal direction of the reinforcing wall forming portion 84, and E is the combined cross sectional area [the sum of the hatched parts e1 and e2 in FIG. 15(*a*)] of the two subprojections 102 in section along a plane perpendicular to the longitudinal direction of the reinforcing wall forming portion 84.

The projection 100 and the recess 101, which are each one in number, may be formed in the respective wall forming portions 83, 84. Assuming that the projection 100 and the recess 101 are L1 in length and that the reinforcing wall forming portions 83, 84 are L in length in this case, these lengths satisfy the relationship of $0.01 \leqq L1/L \leqq 1$.

The reinforcing wall forming portions 83, 84 may be provided with a plurality of projections 100 and a plurality of recesses 101, respectively, as arranged at a spacing longitudinally of the wall forming portion. Assuming that the combined length of all the projections 100 and all the recesses 101 is L2 and that the length of each of the reinforcing wall forming portions 83, 85 is L in this case, these lengths satisfy the relationship of $0.01 \leqq L2/L$.

In producing the flat tube of the present embodiment, the metal plate 80 is bent into the shape of a hairpin at the joint portion 88 by roll forming to butt the side wall forming portions 81, 82 and the reinforcing wall forming portions 83, 84 in corresponding relation in mating pairs and to fit the projections 100 into the recesses 101. At this time, the subprojections 102 deform to press the projections 100 on opposite side faces thereof, thereby preventing the projections 100 from slipping out of the recesses 101 and tacking the metal plate in the bent form [see FIG. 15(*b*)]. With the exception of this feature, the present flat tube is produced by the same process as the flat tube of Embodiment 7. When each projection 100 is fitted into the recess 101, the projection 100 and the recess 101 deform owing to the deformation of the subprojections 102, consequently creating a very small clearance 103 between the upper end face of the projection 100 and the bottom face defining the recess 101. This clearance 103 is filled up with a brazing material 104 as in the case of the production process for the flat tube of Embodiment 7.

As is the case with the process for producing the flat tube of Embodiment 7, when pressure acts on the flat wall forming portions 89, 90 during brazing to bring these portions toward each other, the fitting of each projection 100 in the recess 101 prevents the side wall forming portions 81, 82 from being displaced from each other and each reinforcing wall forming portion 83 or 84 from being displaced from like portion 84 or 83 in pair, in the direction of thickness thereof, i.e., widthwise of the flat wall forming portions 89, 90. Accordingly when the plate is brazed in this state, the wall forming portions 81, 82, 83, 84 are reliably brazed in mating pairs over the entire length thereof to give greatly improved pressure resistance to the flat tube 70 obtained.

In the case where the flat tube of the present embodiment is used, for example, as the refrigerant flow tube 112 of the condenser shown in FIG. 16, such flat tubes may be fabricated simultaneously with the condenser. Thus, the condenser is fabricated in the same manner as is the case with Embodiment 7 except that the bent metal plate for forming the flat tube is tacked in the manner described.

According to Embodiment 8, the projection and the recess may be the same as those of Embodiment 7 in shape and dimensions.

Embodiment 8 will be described next with reference to specific examples and comparative examples.

Examples 11-15 and Comparative Examples 9-11

Two plates, measuring 100 mm in length, 0.5 mm in thickness and 0.4 mm in height, were prepared from an aluminum material which was 70 kN/mm$^2$ in Young's modulus and 0.33 in Poisson's ratio. Formed on a side surface of one of the plates was a ridge positioned in the widthwise midportion thereof and extending over the entire length of the plate longitudinally thereof. Formed in a side surface of the other plate was a recess positioned in the widthwise midportion thereof and extending over the entire length of the plate longitudinally thereof. A subprojection was formed on the side surface of the plate having the recess, on at least one of opposite side portions of the recess. FIG. 15(*a*) shows the projection and the recess in cross section along a plane perpendicular to the length of the plate, and the subprojection in cross section along a plane perpendicular to the length of the plate. The plate having the projection and the plate having the recess were used as a pair of test pieces. Thus, eight pairs of test pieces were prepared. The plates had surfaces which were 0.3 in coefficient of friction.

Table 2 shows values or details of the pairs of test pieces, i.e., the sum (A+a) of the cross sectional area of the projection in section along a plane perpendicular to the longitudinal direction of the plate and the cross sectional area of the recess in section along a plane perpendicular to the longitudinal direction of the plate, the number of subprojections, the width F of the subprojection [see FIG. 15(*a*)], the height G of the subprojection [see FIG. 15(*a*)], the combined cross sectional area E [=e1+e2, see FIG. 15(*a*)] of subprojections in section along a plane perpendicular to the length of the plate, and E/(A+a). In the case of one subprojection, the subprojection is formed at one side of the recess, and the cross sectional area of one subprojection is the combined cross sectional area. In the case of two subprojections, the subprojections are formed at respective opposite sides of the recess.

TABLE 2

| | Subprojection size, mm | | Sum of areas of projection and recess | Combined subprojection | Number of | Area ratio | |
|---|---|---|---|---|---|---|---|
| | Height G | Width F | A + a (mm$^2$) | area E (mm$^2$) | subprojections | E/(A + a) | Effect |
| Example 11 | 0.03 | 0.03 | 0.045 | 0.00045 | 1 | 0.010 | ○ |
| Example 12 | 0.03 | 0.03 | 0.045 | 0.0009 | 2 | 0.020 | ○ |
| Example 13 | 0.10 | 0.10 | 0.045 | 0.01 | 2 | 0.222 | ○ |
| Example 14 | 0.13 | 0.12 | 0.045 | 0.0156 | 2 | 0.347 | ○ |
| Example 15 | 0.15 | 0.15 | 0.045 | 0.0225 | 2 | 0.500 | ○ |
| Comp. Ex. 9 | 0.01 | 0.01 | 0.045 | 0.00005 | 1 | 0.001 | X |
| Comp. Ex. 10 | 0.02 | 0.02 | 0.045 | 0.0004 | 2 | 0.009 | X |
| Comp. Ex. 11 | 0.18 | 0.13 | 0.045 | 0.0234 | 2 | 0.520 | X |

The test pieces of each pair had their side surfaces brought into contact with each other, with the projection fitted into the recess. The pair of plates were then pulled apart for separation to check whether a force was necessary for separation. The result is given in the column of "Effect" in Table 2. With reference to this column of Table 2, the circle mark indicates that a predetermined force was required when the plates were pulled apart for separation, while the cross mark indicates that no force was needed for pulling the plates apart for separation.

The result listed in Table 2 shows that Examples 11 to 15 satisfying the relationship $0.0 \leqq E/(A+a) \leqq 0.5$ required a force for removing the projection from the recess. This substantiates that when the projection and the recess are used for the metal plate for producing a flat tube, that is, when the metal plate is bent into the shape of hairpin to butt the side wall forming portions 81, 82 and the reinforcing wall forming portions 83, 84 in corresponding relation or mating pairs, to fit the projection 100 into the recess 101, and to cause the deformed subprojections 102 to press the side faces of the projection 100, the projection 100 can be prevented from slipping out of the recess 101. As a result, the metal plate can be tacked as bent.

According to Embodiments 7 and 8 described, the projection is formed on each of the reinforcing wall forming portions of one of the flat wall forming portions, and the recess is formed in each of the reinforcing wall forming portions of the other flat wall portion, whereas the projection may alternatively be formed on one of the side wall forming portions with the recess formed in the other sidewall forming portion. Although the projection is formed on each of the reinforcing wall forming portions of one of the flat wall forming portions, with the recess formed in each of the reinforcing wall forming portions of the other flat wall portion according to Embodiments 7 and 8, the projection may be formed on at least one of the reinforcing wall forming portions of one of the flat wall forming portions, with the recess formed in the reinforcing wall forming portion of the other flat wall portion to be positioned end-to-end with the above-mentioned at least one wall forming portion.

The metal plate for use in each of the foregoing embodiments for producing the flat tube is obtained by rolling an aluminum brazing sheet clad with a brazing material over opposite surfaces thereof, whereas the metal plate may be prepared by rolling a usual aluminum sheet of bare aluminum material having no brazing material layer over the surfaces thereof. In this case, the reinforcing wall forming portions, as well as the side wall forming portions, may be brazed in mating pairs, for example, by applying a noncorrosive brazing material.

INDUSTRIAL APPLICABILITY

The invention provides a metal material for use in producing a flat tube useful as the heat exchange tube of heat exchangers, for example, as the refrigerant flow tube of condensers for motor vehicle air conditioners. The flat tube of the invention is suitable for use as the refrigerant flow tube of condensers for motor vehicle air conditioners.

The invention claimed is:

1. A metal plate for producing a flat tube comprising:

a metal body having a joint portion, first and second flat wall forming portions connected by the joint portion, a plurality of reinforcing wall forming portions projecting from the first and second flat wall forming portions and extending in a longitudinal direction of the first and second flat wall forming portions, and side wall forming portions projecting from opposite side edges of the metal body, respectively, wherein the joint portion has a ridge which makes the joint portion thicker than the first and second flat wall forming portions, the ridge, the reinforcing wall forming portions and the side wall forming portions are projecting in a same direction, and the metal body is configured to be bent into a hairpin shape at boundaries formed between the ridge of the joint portion and the first and second flat wall forming portions.

2. A metal plate for producing a flat tube according to claim 1, wherein the metal body has a plurality of scores which extend at boundaries between the ridge of the joint portion and the first and second flat wall forming portions, respectively, over an entire length of the metal body in the longitudinal direction of the first and second flat wall forming portions.

3. A metal plate for producing a flat tube according to claim 1, wherein the metal body has a plurality of scores on a first surface on which the ridge and the reinforcing wall forming portions are formed and on a second surface which is an opposite side of the first surface, and the scores extend at boundaries between the ridge of the joint portion and the first and second flat wall forming portions, respectively, over an entire length of the metal body in the longitudinal direction of the first and second flat wall forming portions.

4. A metal plate for producing a flat tube according to claim 1, wherein the joint portion has a furrow extending over an entire length of the metal body in the longitudinal direction of the first and second flat wall forming portions.

5. A metal plate for producing a flat tube according to claim 1, wherein the metal body has a plurality of scores which extend at boundaries between the ridge of the joint portion and the first and second flat wall forming portions, respectively, over an entire length of the metal body in the longitudinal direction of the first and second flat wall forming portions, and the joint portion has a furrow extending over an entire length of the metal body in the longitudinal direction of the first and second flat wall forming portions.

6. A metal plate for producing a flat tube according to claim 1, wherein the metal body comprises an aluminum brazing sheet, the side wall forming portions and the reinforcing wall forming portions are formed on a brazing material bearing surface of the aluminum brazing sheet, and the side wall forming portions and the reinforcing wall forming portions include brazing material layers, respectively.

* * * * *

UNITED STATES PATENT AND TRADEMARK OFFICE

CERTIFICATE OF CORRECTION

PATENT NO. : 7,749,609 B2
APPLICATION NO. : 11/964412
DATED : July 6, 2010
INVENTOR(S) : Satoru Kaimura et al.

It is certified that error appears in the above-identified patent and that said Letters Patent is hereby corrected as shown below:

On the title page, Item (62), the Related U.S. Application Data information is incorrect, and Item (30), the Foreign Application Priority Data has been omitted. Item (62) and (30) should read:

-- Related U.S. Application Data

(62) Division of application No. 10/479,860, filed on Dec. 8, 2003, now Pat. No. 7,341,099 which is a 371 of PCT/JP02/05575, filed on Jun. 6, 2002.

(30) Foreign Application Priority Data

June 8, 2001 (JP).....2001-174459 --

Signed and Sealed this

Twelfth Day of October, 2010

David J. Kappos

David J. Kappos
*Director of the United States Patent and Trademark Office*